United States Patent [19]

Nakai

[11] Patent Number: 5,007,262

[45] Date of Patent: Apr. 16, 1991

[54] DIAL LOCK

[75] Inventor: Hatsuo Nakai, Toyonaka, Japan

[73] Assignee: Clover Co., Ltd., Osaka, Japan

[21] Appl. No.: 367,722

[22] Filed: Jun. 16, 1989

Related U.S. Application Data

[63] Continuation-in-part of Ser. No. 215,584, Jul. 6, 1988, Pat. No. 4,905,488.

[51] Int. Cl.[5] ..... E05B 37/02

[52] U.S. Cl. ..... 70/312; 70/306; 70/309; 70/315

[58] Field of Search ..... 70/119, 304, 306, 308–315, 70/316–319

[56] References Cited

U.S. PATENT DOCUMENTS

| | | | |
|---|---|---|---|
| 1,078,120 | 11/1913 | Ziehler | 70/306 |
| 1,579,046 | 3/1926 | Wildrick | 70/312 X |
| 1,947,813 | 2/1934 | Theriot | 70/306 |
| 2,007,663 | 7/1935 | Rapp | 70/306 |
| 2,165,674 | 7/1939 | Pelle | 70/306 X |
| 2,621,508 | 12/1952 | Porche | 70/309 X |
| 2,640,344 | 6/1953 | Margo | 70/306 X |
| 2,886,962 | 5/1959 | Soler Marti et al. | 70/306 |
| 2,896,439 | 7/1959 | Holmberg | 70/306 X |
| 3,462,984 | 8/1969 | Soler Marti et al. | 70/310 |
| 3,633,388 | 1/1972 | Atkinson | 70/312 X |
| 4,027,508 | 6/1977 | McGourty | 70/306 X |
| 4,048,821 | 9/1977 | Bako et al. | 70/314 X |
| 4,602,491 | 7/1986 | Mauer | 70/306 X |
| 4,732,020 | 3/1988 | Pieddeloup | 70/306 X |
| 4,754,623 | 7/1988 | Hwang | 70/312 X |

*Primary Examiner*—Robert L. Wolfe
*Assistant Examiner*—Suzanne L. Dino
*Attorney, Agent, or Firm*—David G. Conlin; Robert M. Asher

[57] ABSTRACT

A dial lock comprises: a slide bar (10) which is controlled of its movement by engagement with a lock pin (2), dials (3) for controlling movement of the lock pin (2) with respective optional retrieving number, return-to-zero gears (6) to return the dials (3) to these zero-indicating positions at the time of locking and unlocking, and anti-locking means for enabling the locking only after a case when at least one of the dials is set to indicate a number other than zero, whereby optional unlocking number can be set without fail in locking operation.

4 Claims, 22 Drawing Sheets

DIAL LOCK

This is a continuation-in-part of co-pending application Ser. No. 07/215,584 filed on Jul. 6, 1988, and now U.S. Pat. No. 4,905,488.

FIELD OF THE INVENTION AND RELATED ART STATEMENT

1. Field of the Invention

The present invention relates to a dial lock which does not require a key for locking and unlocking and, in particular, to a dial lock which permits setting of an optional number for unlocking by a layman user.

2. Description of the Related Art

Recently, dial locks capable of being locked and unlocked without use of key have been widely used for lockers and safes in sports facilities.

Conventional mechanical dial locks are classified into two types, one that has an unreplaceable specific number for unlocking and the other with a number that can be replaced by operating the mechanism of the lock. Further, electric dial locks have been put into use these days.

Such conventional dial locks have the following problems. The dial lock having an unreplaceable unlocking number can be unlocked for an unjustifiable purpose by an unauthorized person who has learned the unlocking number. On the other hand, the dial lock having a replaceable unlocking number requires an operation of the internal mechanism with a given pin or lever inserted thereinto, whereby a layman user unfamiliar to the lock mechanics inevitably suffers a difficulty in replacing the unlocking number each time the lock is used.

Further, the electric dial lock allows setting of an optional unlocking number by adapting the electronic circuit to memorize the unlocking number, for example, with the digit key (ten-key) operated. Such lock requires a power source and, therefore, is subject to the problem of the loss of operability or of capability of being unlocked due to the loss of memory in the electronic circuit because of a power stoppage.

OBJECT AND SUMMARY OF THE INVENTION

The present invention provides a purely mechanical dial lock permitting easy setting of an optional unlocking number for the use thereof while eliminating such problems as described above. Another object of the present invention is to provide a dial lock capable of easy and exact operation to set digits for locking and unlocking. A further object of the invention is to provide a dial lock which, once locked, is firmly secured from external forcible unlocking.

The dial lock in accordance with the present invention comprises:

a lock pin having a plurality of projections formed at fixed spatial intervals along the axial direction thereof;

a slide bar having projections and recesses in a fixed configuration at the side thereof abutting on one end of the lock pin, subjected to control over the movement thereof by engagement of the projections and recesses with the lock pin, and serving for opening and closing the door while acting in association with the locking part to lock the door;

dials amounting to the number corresponding to that of projections of the lock pin, each provided with digits numerals on the outer periphery thereof, and each having an internal gear toothed at the inner periphery to be interlocked with an external gear of the below-mentioned dial lock gear so that an optionally fixed code number is set for enabling locking and unlocking;

return-to-zero gears each engaging with the dial for returning the dial to the zero-indicating position;

anti-locking means for retaining the slide bar at a position of unlocking and preventing the door from being locked;

interlocking levers which move in association with the dials through the return-to-zero gears and prevent the locking operation of the slide bar by bringing the anti-locking means into engagement with the slide bar when the slide bar is in an unlocking position and under such condition that all the dials are set zero, and permit a locking operation of the slide bar by bringing the anti-locking means into disengagement from the slide bar when the slide bar is in the locking position under such condition that at least one of the dial is set at a number other than zero;

arms acting in association with the locking and unlocking operations of the slide bar and actuating the return-to-zero gears for returning the dials to the zero-indicating positions at the time of locking and unlocking;

dial lock gears respectively having gates to be in and out of engagement with the projection of the lock pin at the inner periphery thereof and, having peripheral teeth as the external gear on outer periphery thereof, to be in and out of engagement with the internal gear on the inner periphery of the dial, to set an unlocking number of the dial and to control the axial movement of the lock pin, depending on the engagement relation between the gate and the projection of the lock pin as well as between the external gear and the internal gear in the following relation:

(a) at the time of unlocking, the projection fits into the gate and the external gear are out of engagement with the internal gear of the dial, or (b) at the time of locking, the external gear are in engagement with the internal gear of the dial and the projection does not fit into the gate on account of positional deviation therebetween.

For preventing abuse by an unauthorized person, it is possible to make a system to provide slide-bar-latching means for fixing the slide bar in the unlocking position to prevent locking and abuse-preventive means having the slide bar release means for releasing the slide bar from the slide-bar-latching means.

Further, in preparation for opening the door and retrieving the unlocking number when the number has been forgotten by the user, it is possible to use unlocking means capable of opening the locking part of the door while the slide bar is in the locking position. And further, retrieval means having a retrieval pin which can be used only when operated from the inside of the door and fitting into a small hole formed in a fixed position on each dial lock gear at positional agreement of the gate of the dial lock gear with the projection of the lock pin.

Further, a dial lock in accordance with the present invention may have a setting part which comprises:

a lock pin having a plurality of projections formed at fixed spatial intervals along the axial direction thereof;

a slide bar having a projection and a recess in fixed configuration at the side thereof abutting on one end of the lock pin, subjected to control over the movement thereof by engagement of the projection and recess with the lock pin, and serving for opening and closing the door while acting in association with the locking part to lock the door;

lock gears disposed on the same axis as the rotating shaft of the lock pin, numerically corresponding to projections of the lock pin, having gates to detachably engage with projections of the lock pin on the inner periphery and also having gearing teeth on the outer periphery thereof;

intermediate gears having internal teeth to detachably engage with external gearing teeth on the outer periphery thereof;

dials having gearing teeth to engage with the external gearing teeth of the intermediate gears, and having digits on the outer periphery thereof;

return-to-zero gears fixed to the dials for returning the dials to the zero-indicating position;

interlocking levers to catch the slide bar while engaging with the return-to-zero gears when the dials are all set at zero and to permit locking operation of the slide bar when at least one of the dials is set at any number other than zero;

return cams provided on the slide bar for controlling the operation of the interlocking levers:

arms acting in association with locking and unlocking operation of the slide bar and driving the return-to zero gears for adapting the dials to return to the zero-indicating positions at the time of locking and unlocking; and manual operation plates having gearing teeth to engage with the external gearing teeth of the intermediate gears.

Furthermore, the above-mentioned structure may be provided, at the locking part, with:

a rack plate operating in association with locking and unlocking operation of the slide bar; and a lock plate to be locked or unlocked by the action of the rack plate and each having a projection fitted into a part of the rack plate at the time of locking.

When an optional number (called an unlocking number hereinafter) is set with the dials operated in the state of unlocking (before locked) applied according to the present invention, the slide bar becomes ready for locking. Then, the slide bar operates for locking and, with the finish of locking operation, the arm is driven by the slide bar and the dial is returned to the zero-indicating position by the action of the return-to-zero gear. At this time, the lock pin engages with the recess of the slide bar and the projection of the lock pin deviates from the gate of the dial lock gear and abuts on the side of the dial lock gear. As a result, the action of the lock pin is interrupted and, therefore, the slide bar is prevented from operating and the dial lock is kept locked.

On the other hand, if an unlocking number is set with the dial operated on the dial lock that has been locked, the projection of the lock pin positionally agrees with the gate of the dial lock gear, to enable the lock pin to move in the axial direction. Thus, it becomes possible to perform unlocking with the slide bar operated. An unlocking operation at this stage adapts the slide bar to act for unlocking and the slide bar drives the arm so that the dial is returned to the zero-indicating position by the action of the return-to-zero gear. At this time, engagement of the dial with the dial lock gear is cut off and the dial lock is unlocked as it was before used, whereby setting of an optional unlocking number and locking is enabled.

DESCRIPTION OF THE PREFERRED EMBODIMENT

First Embodiment

A first embodiment of the present invention will be described with reference to the drawings.

Figure 1:
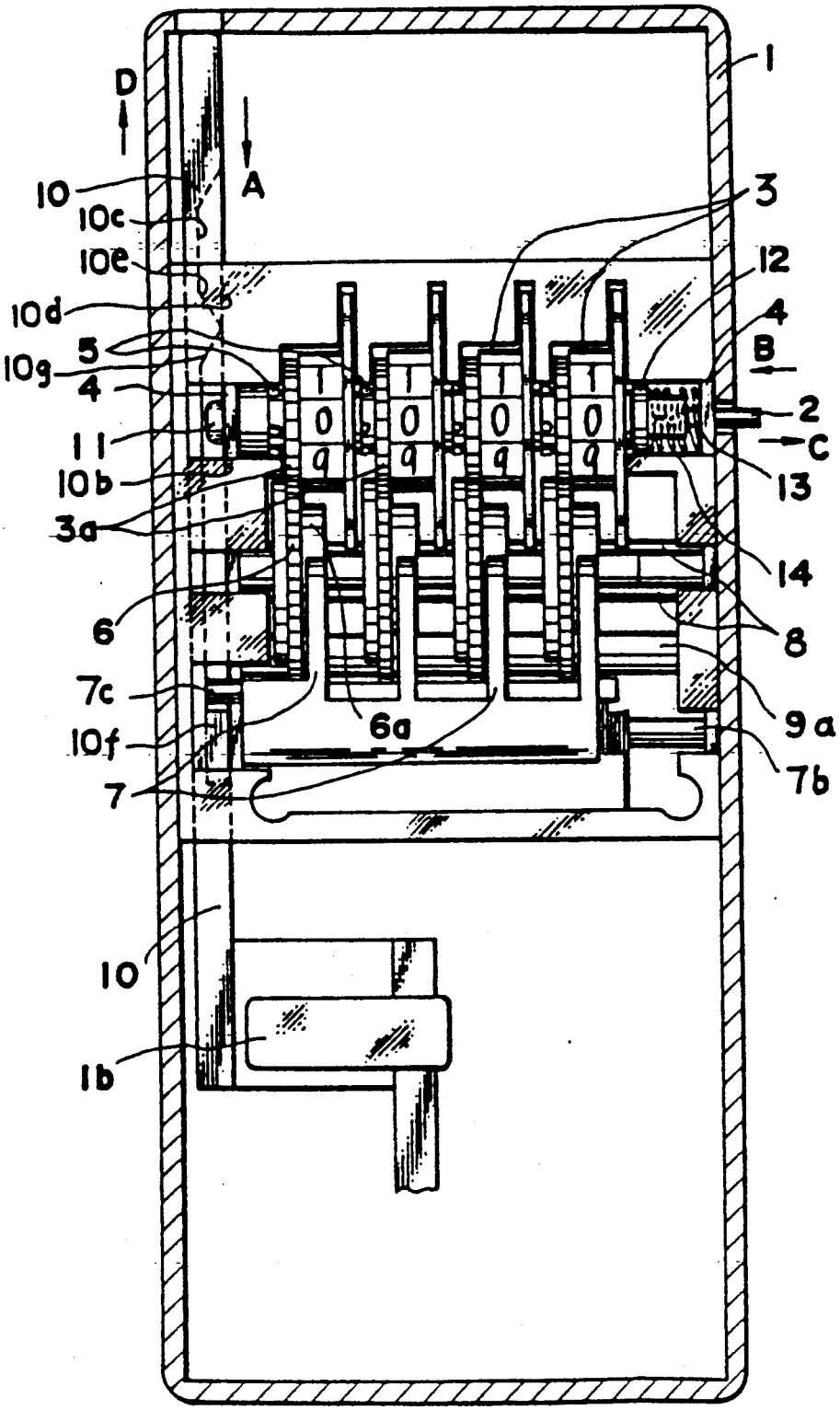
FIG. 1 is a front view of an internal part of a dial lock as a first embodiment of the present invention.
Figure 1A:
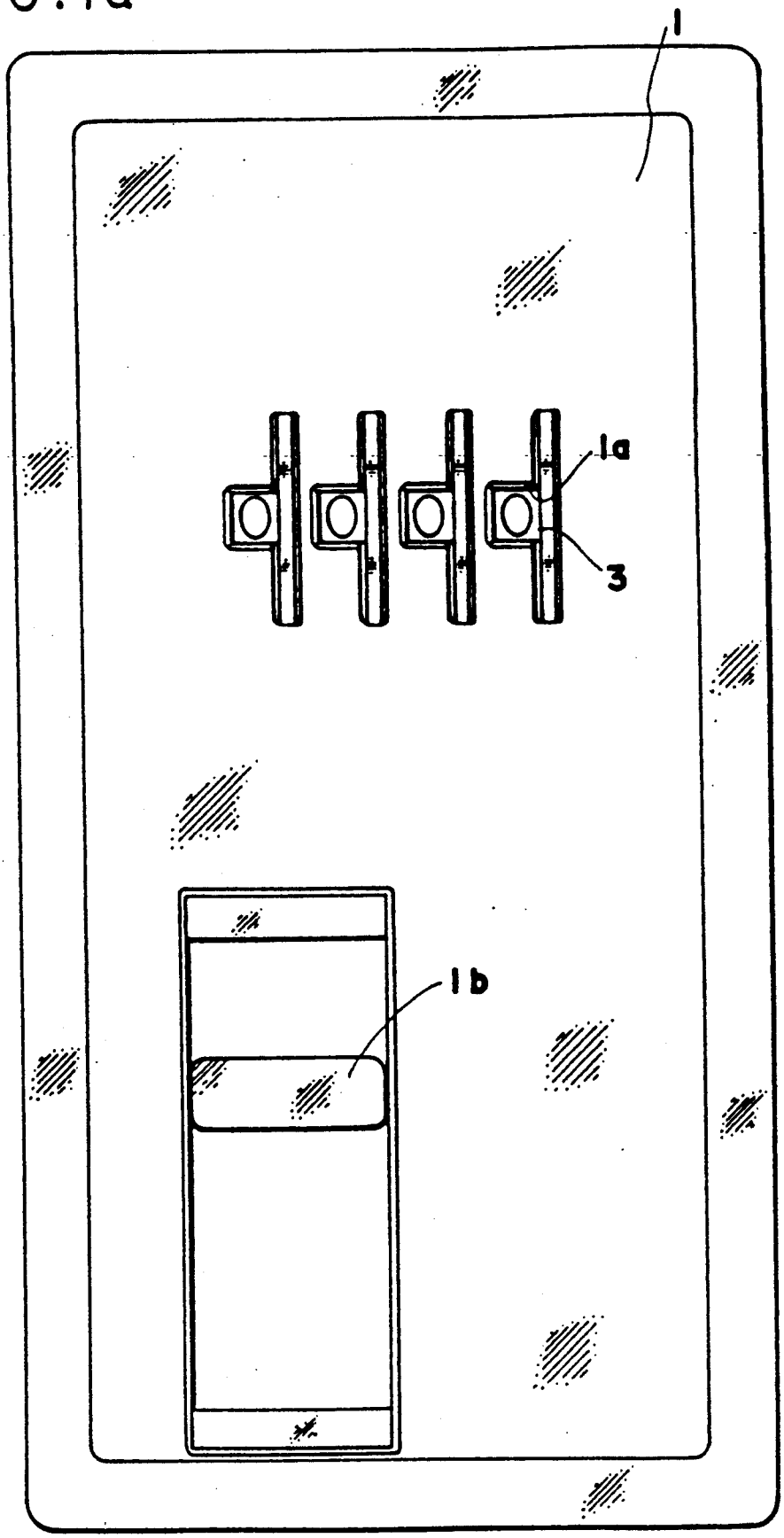
FIG. 1*a* is a front view of an appearance thereof.
Figure 2:
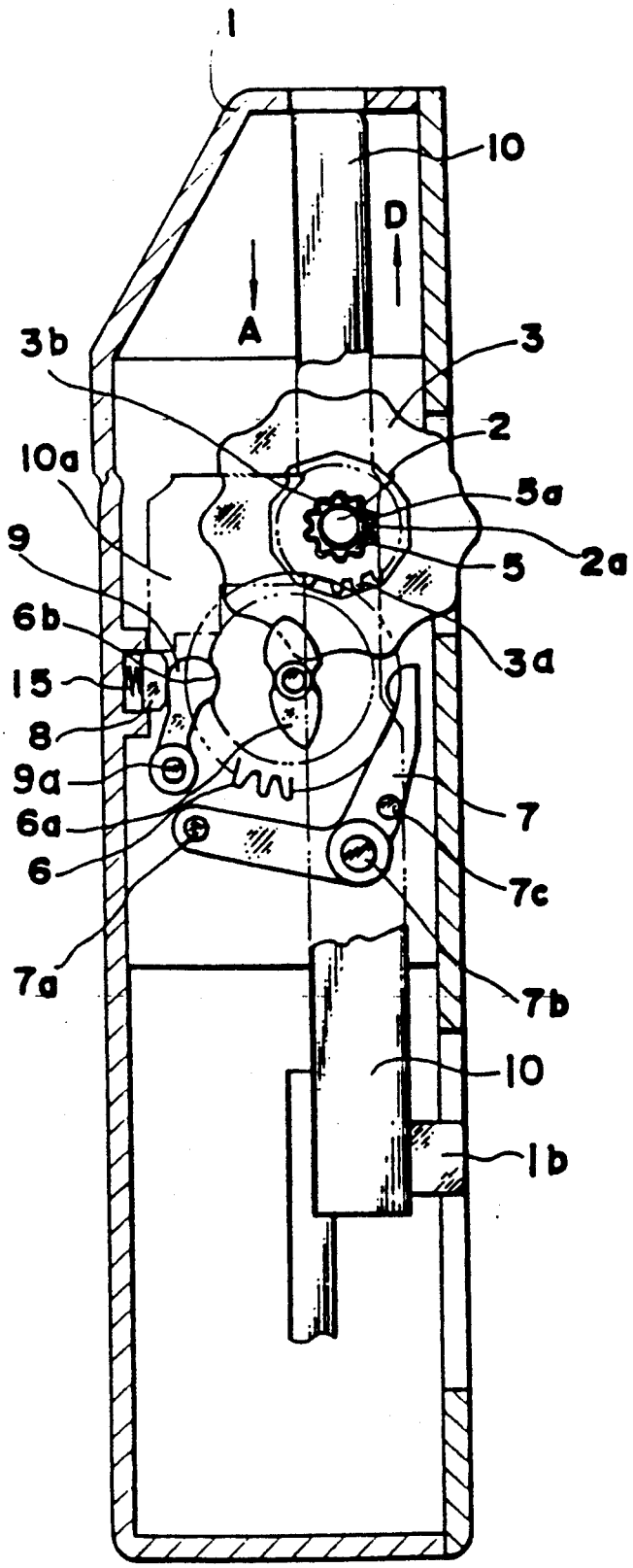
FIG. 2 is a side view of the first embodiment shown in FIG. 1.

FIGS. 1 and 2 are a front view and a side view, respectively, of an inner part of the dial lock which has been unlocked. As shown in the drawings, the dial lock contained in the case 1 comprises: a slide bar 10 to control opening/closing of a part to be locked (not shown) in an object to be closed and opened, such as a locker door; a lock pin 2 which is retained by a retentive plate 4 at both ends so as not to rotate freely, and is for controlling the operation of the slide bar 10; plural dials 3 rotatably journaled by the lock pin 2 for setting of locking and unlocking retrieval numbers; and dial lock gears 5 each engaging with the dial 3. The dial lock further comprises plural rotatably journaled return-to-zero gears 6 engaging with gears 3*a* provided on respective dials 3 so as to return these dials 3 to zero-indicating positions, and arms 7 for engaging with heart-shaped cams 6*a* each provided on the side face of the return-to-zero gear 6 for actuating these gears 6. On the side of the return-to-zero gear 6, a cutout 6b, which is to be engaged with an interlocking lever 9 when the dial 3 is in the zero-indicating position, is provided. The interlocking levers 9 are journaled by a shaft 9a and abut on anti-locking means 8 which controls the movement of the slide bar 10. A first bush 11 and a second bush 12 are provided respectively on respective ends of the lock pin 2. Besides, a first spring 13 for pushing the lock pin 2 leftward (in the direction of arrow B) and a second spring 14 for pushing the dial lock gear 5 leftward (in the direction of arrow B), correspondingly to the movement of the slide bar 10b, are provided on one end. FIG. 1a is a view of an appearance of this embodiment. Therein, the case 1 has number-windows 1a, through which digits on the dials appear, and further has an operation window 1b wherein the slide bar 10 is exposed for operation from the outside of the door.

The operation of the first embodiment will be described below.

Operation from Unlocking to Locking

As shown in FIGS. 1 and 2, while the dial lock is kept unlocked, the plural dials 3 are all returned to zero-indicating positions as will be described later. At this time, the plural interlocking levers 9 corresponding to the dials 3 engage with the cutouts 6b of the return-to-zero gears 6 and, therefore, anti-locking means 8 floats upwards being pushed by the spring 15, abuts on an L-shaped projection 10a of the slide bar 10, and prevents the slide bar 10 from moving downward (in the direction of arrow A).

Figure 3:
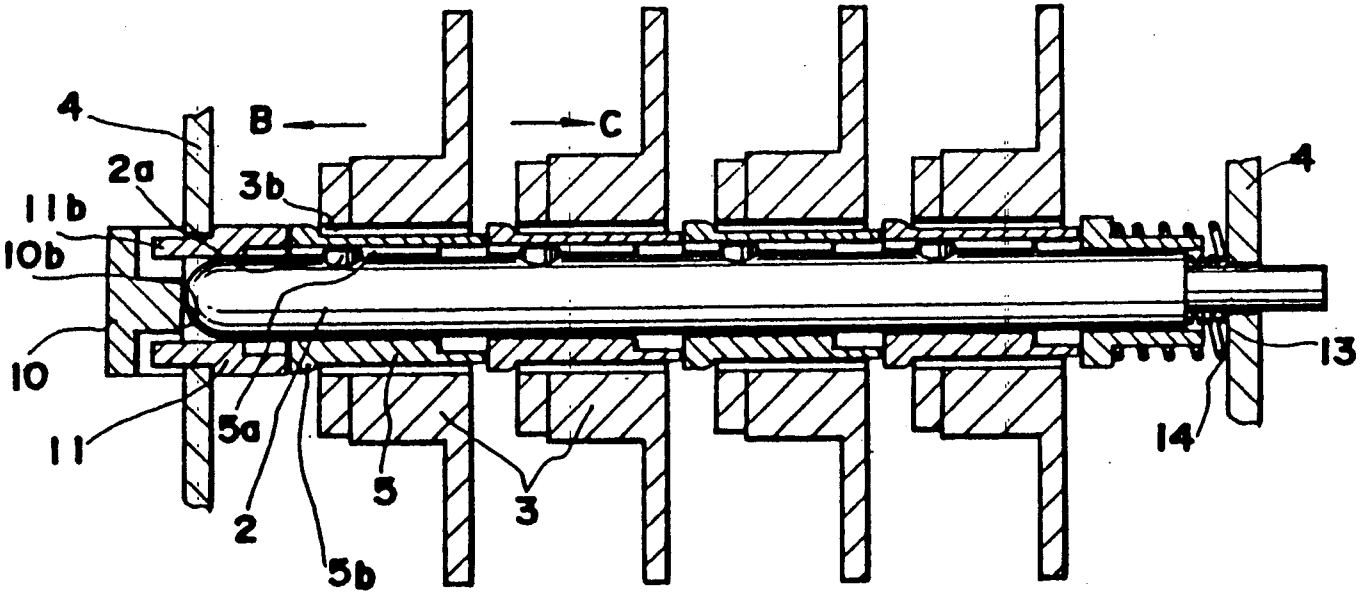
FIG. 3 is a sectional view of a nearby part of the lock pin appearing while the dial lock is kept unlocked.
Figure 8:
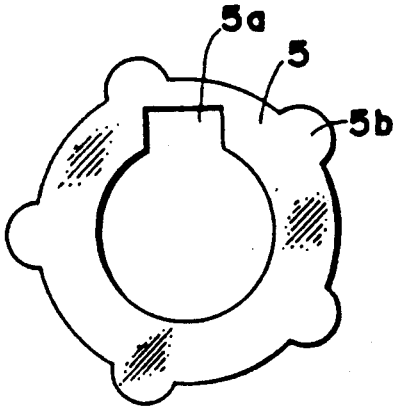
FIG. 8 is a view of a dial lock gear.

As shown in FIG. 3, which is an enlarged view of the vicinity of the lock pin 2, and FIGS. 4 through 7, which are enlarged views of the slide bar 10, the lock pin 2 is pushed rightward (in the direction of arrow C) by the projection 10b of the slide bar 10 while the dial lock is kept unlocked. Meanwhile, the dial lock gear 5 is pushed in the direction of arrow B by the 2nd bush 12 energized by the 2nd spring 14, and is in the left position. Accordingly, the projection 2a of the lock pin 2 fits into the gate 5a formed inside the dial lock gear 5 shown in FIG. 8 and the lock pin 2 engages with the dial lock gear 5. However, since the dial lock gear 5 is pushed leftward (in the direction of arrow B) by the 2nd spring 14, the external gear 5b of the dial lock gear 5 are out of engagement with the internal gear 3b formed inside the dial 3 to permit the dial 3 to be rotated as desired. Setting of an unlocking number is possible in such a state as above.

Figure 9:
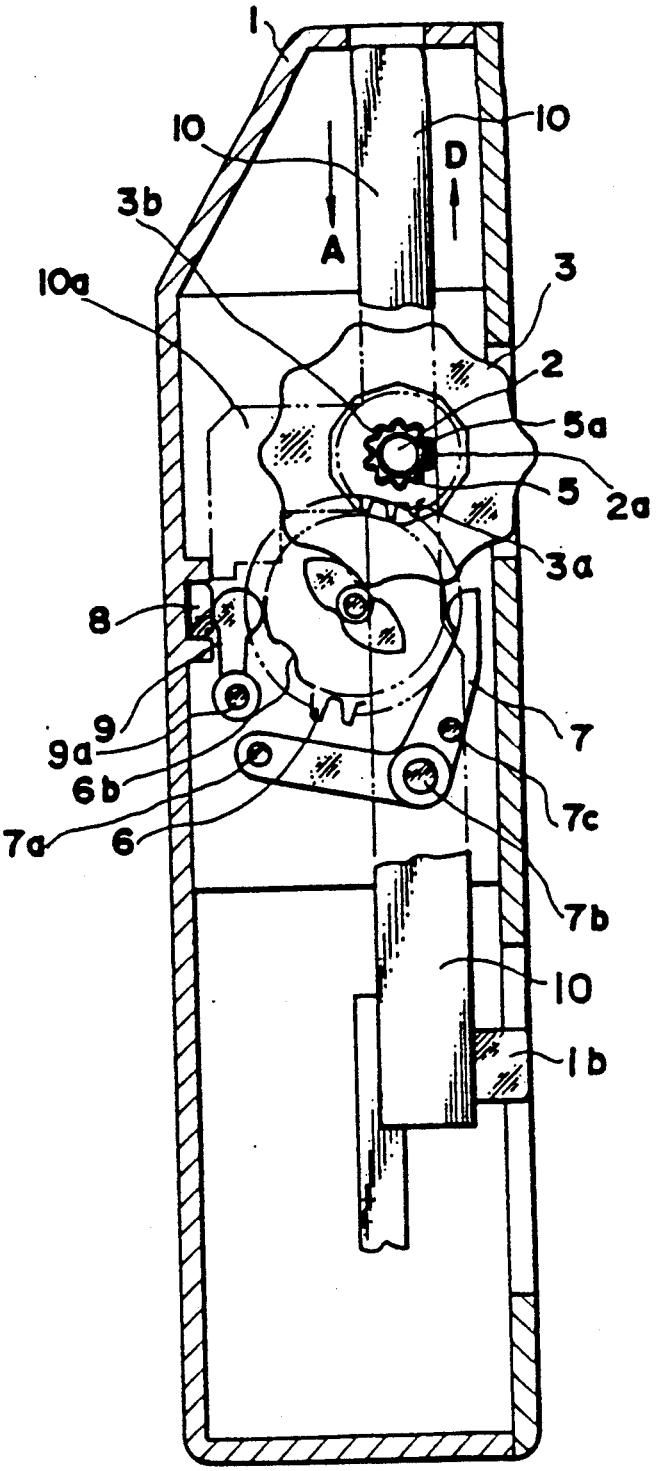
FIGS. 9 and 10 are side views for explaining the operation of the first embodiment.
Figure 10:
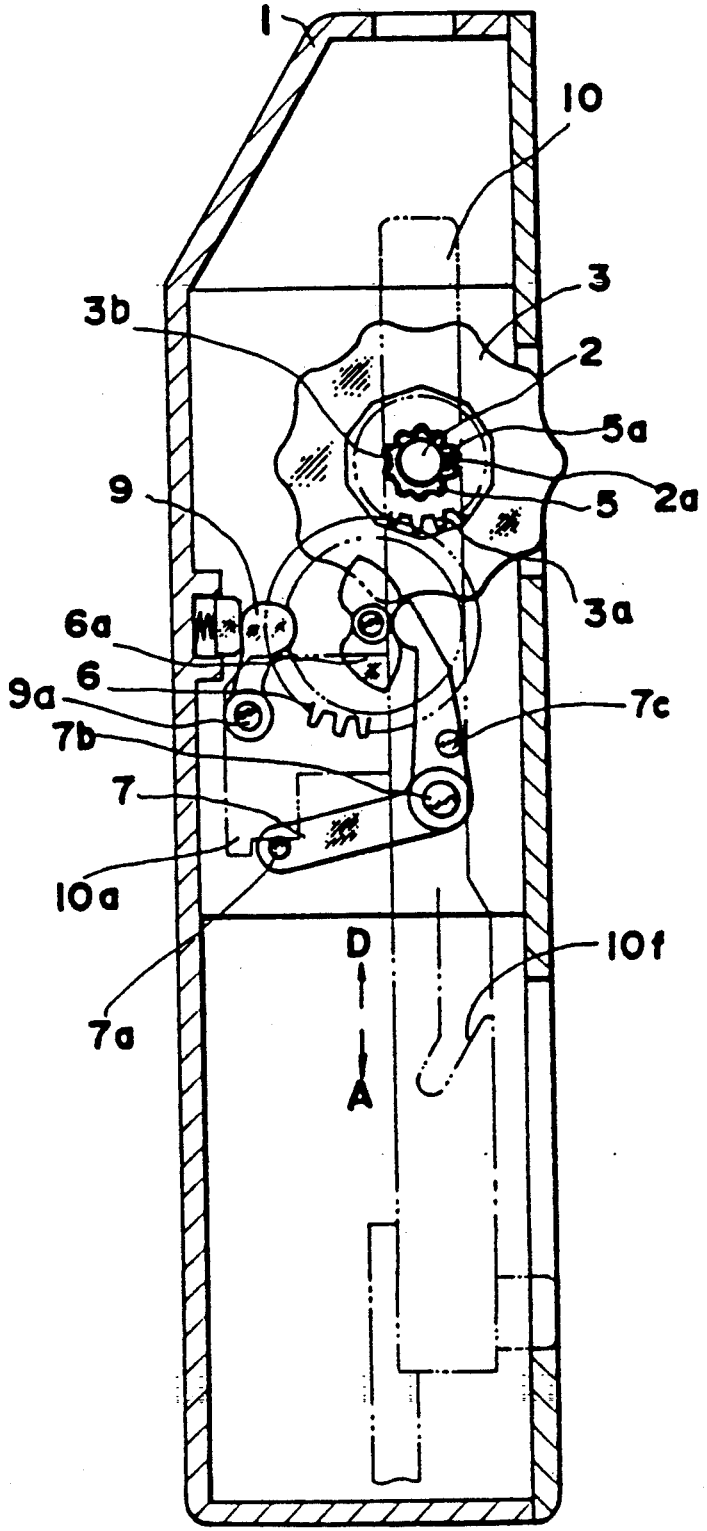
Figure 11:
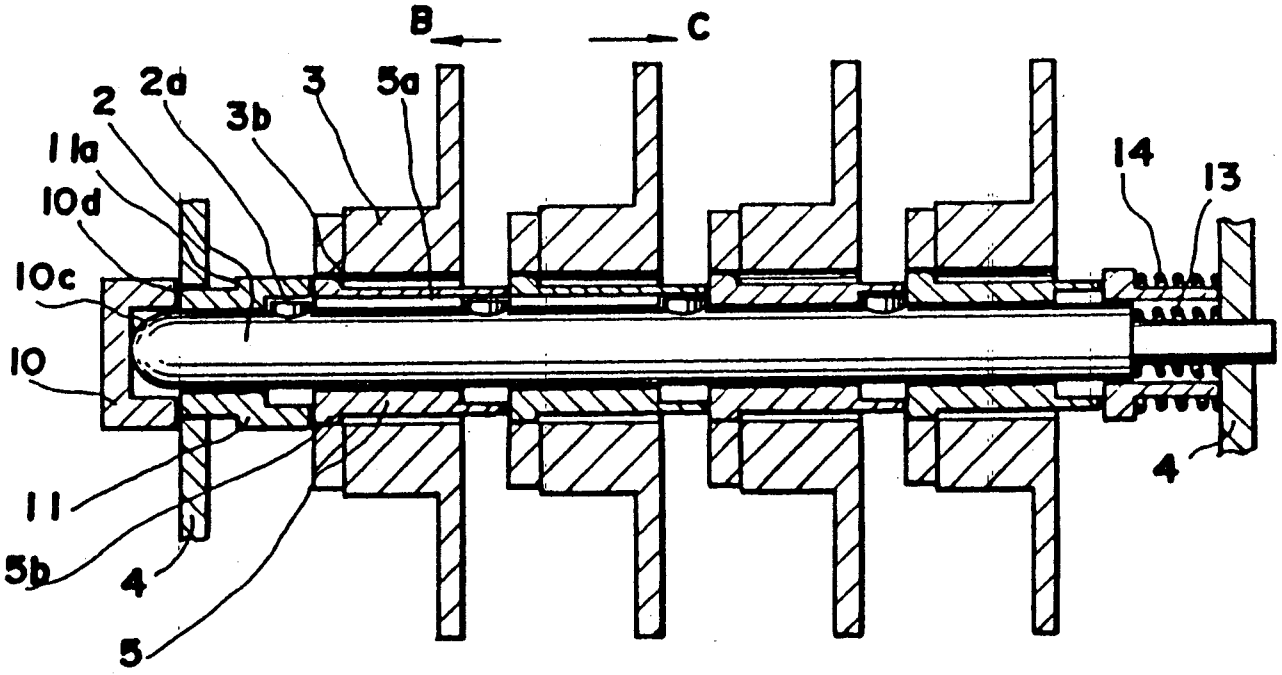
FIG. 11 is a sectional view showing the vicinity of the lock pin appearing while the dial lock is kept locked.

When at least one of the dials 3 is turned to indicate a number other than zero, (setting of an unlocking number), the return-to-zero gear 6 is rotated by the gear 3a of the dial 3 and the interlocking lever 9 is disengaged from the cutout 6b, whereby anti-locking means 8 is pushed by the interlocking lever 9 and adapted to be out of contact with the L-shaped projection 10a of the slide bar 10 (FIG. 9). As a result, the slide bar 10 can be lowered down (in the direction of arrow A). That is, locking can be made only after setting of an unlocking number. When the slide bar 10 is lowered down, the lower end of the L-shaped projection 10a presses the pin 7a of the arm 7 downwards as shown in FIG. 10 and the arm 7, thereby, turning the arm 7 around the axis 7b. And the upper end of the arm 7 presses the heart-shaped cam 6a, actuates the return-to-zero gear 6, and returns the dial 3 to the zero-indicating position.

Figure 3A:
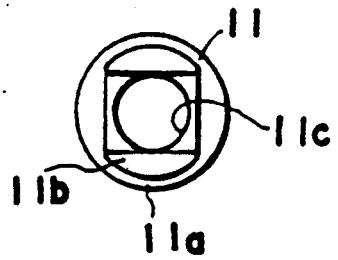
FIGS. 3*a* and 3*b* are a plan and a front view, respectively, of a first bush.
Figure 3B:
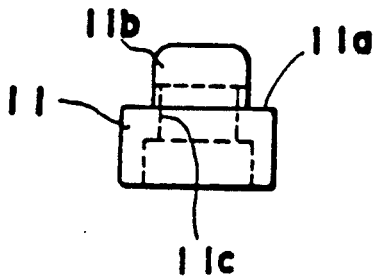
Figure 4:
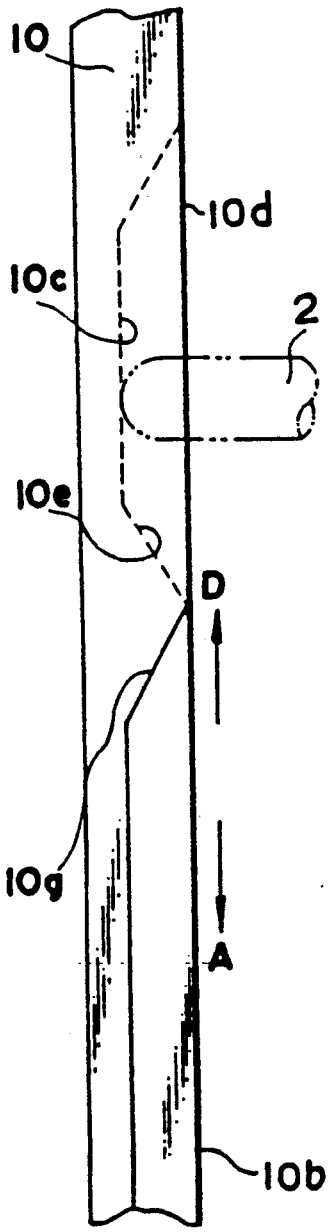
FIGS. 4 and 5 are a side view and a front view, respectively, of the slide bar.
Figure 5:
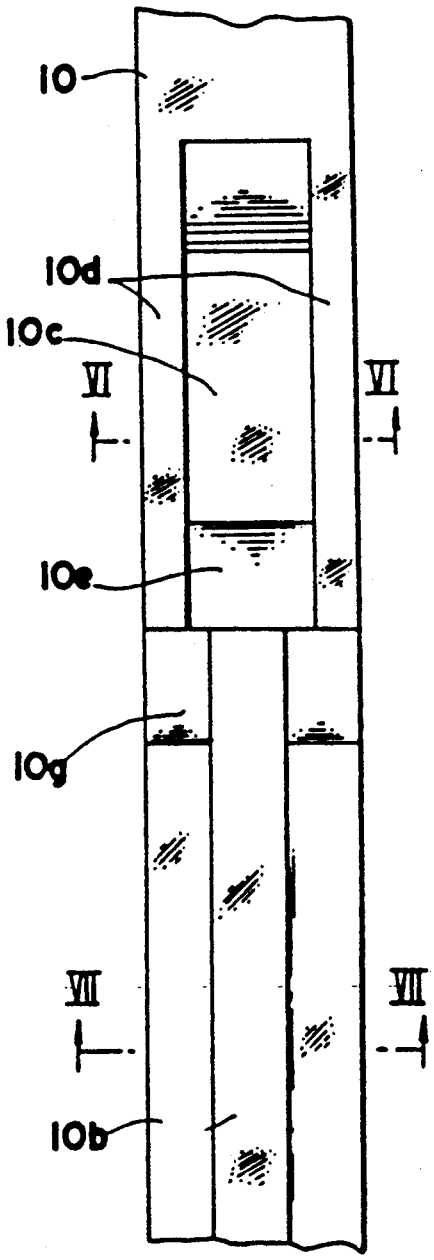
Figure 6:
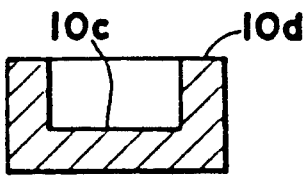
FIGS. 6 and 7 are sectional views taken along the lines VI—VI and VII—VII, respectively, in FIG. 5.
Figure 7:
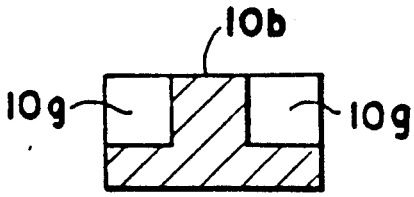

When the slide bar 10 is lowered down as described above, the lock pin 2 fits into the recess 10c (see FIG. 4 and FIG. 5) of the slide bar 10, and hence the pin 2 moves leftward by the force of the spring 14 as shown by FIGS. 1, 3 (in the direction of arrow B). On the other hand, a two-forked part 11b of the 1st bush 11 as shown in FIGS. 3a and 3b, which are a plan view and a front view, respectively, is pushed by an oblique face 10g and planar faces 10d, on both sides of the recess 10c, to move the dial lock gear 5 rightward (in the direction of arrow C). Consequently, the external gear 5b of the dial lock gear 5 engages with the internal gear 3b of the dial 3. On the other hand, the projection 2a of the lock pin 2 is detached from the external gear 5b of the dial lock gear 5, and hence engagement of the lock pin 2 with the dial lock gear 5 is cut off.

When the dial 3 is returned to the zero-indicating position in such a state as above, the dial lock gear 5 rotates together with the dial 3, and the gate 5a deviates from the dial lock pin 2. Therefore, the projection 2a of the lock pin 2 strikes the dial lock gear 5 and the lock pin 2 is intercepted of rightward motion (in the direction of arrow C). With the interception of rightward motion of the lock pin 2, the lock pin 2 strikes the oblique face 10a of the slide bar 10, if the slide bar 10 is intended to be pushed upward (in the direction of arrow D). In this way, the dial lock is locked.

Operation from Locking to Unlocking

Figure 12:
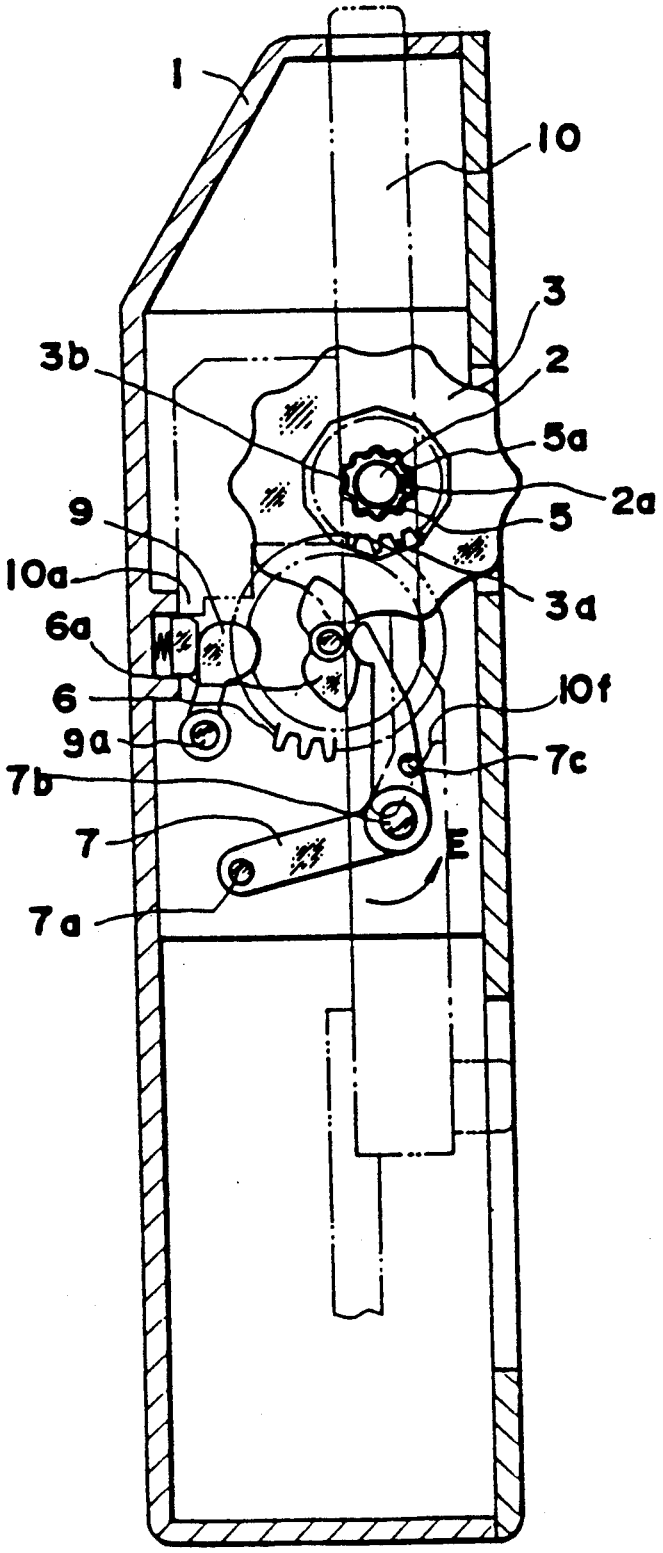
FIG. 12 is a side view for explaining the operation of the first embodiment.

The sequential step from locking state to unlocking state will be described on the first embodiment. When the dials 3, which have been returned to the zero-indicating position after locked, are operated for setting of an unlocking number, the gate 5a of the dial lock gear 5 and the projection 2a of the lock pin 2, which have been hitherto deviated from each other are brought into a state of agreement in circumferential angular position. When the slide bar 10 in such a state as above is intended to be pushed upward, the lock pin 2 is pushed by the oblique face 10e and planar faces 10b of the slide bar 10 to the right side (in the direction of arrow C). As a result of the above-mentioned state of agreement in circumferential angular position, the slide bar 10 can be pushed upward (in the direction of arrow D) (FIG. 3). With the upward thrust of the slide bar 10, a cutout 10f of the slide bar engages with the second pin 7c of the arm 7 and turns the arm 7 in the direction of arrow E as shown in FIG. 12. At this time, the arm 7 engages with the heart-shaped cam 6a of the return-to-zero gear 6, to actuate it thereby returning the dial 3 to the zero-indicating position.

The 1st bush 11, on the other hand, does not abut on the slide bar 10 and moves to a position, at which the stepped part 11a thereof abuts on the retention plate 4. The dial lock gear 5 is pressed by the 2nd bush 12 which is urged by the spring 14 and moves leftward (in the direction of arrow B). Consequently, engagement between the dial 3 and the dial lock gear 5 is cut off (FIG. 3).

As has been described above, in the first embodiment of the present invention, a locking operation of the slide bar 10 is inhibited until an unlocking number is set, and the dial lock is locked without fail once the slide bar operates for locking. Therefore, there is no fear of making a mistake in the locking operation. And moreover, because of the return of the dials 3 to the zero-indicating position at the time of locking and unlocking, there is no need to change the unlocking number to another number after a locking or an unlocking of the lock, in order to protect the unlocking number from being known by the unauthorized person. Incidentally, in the above-mentioned embodiment, the structure is such that the dials 3 are returned to the zero-indicating position, however, another structure, wherein any other number than zero is used for position indication, may be adopted.

Unlocking by an unauthorized person can effectively be prevented by providing a dummy hole on the side whereat the dial lock gear 5 strikes the projection 2*a* of the lock pin at a locking operation.

Second Embodiment

Figure 13:
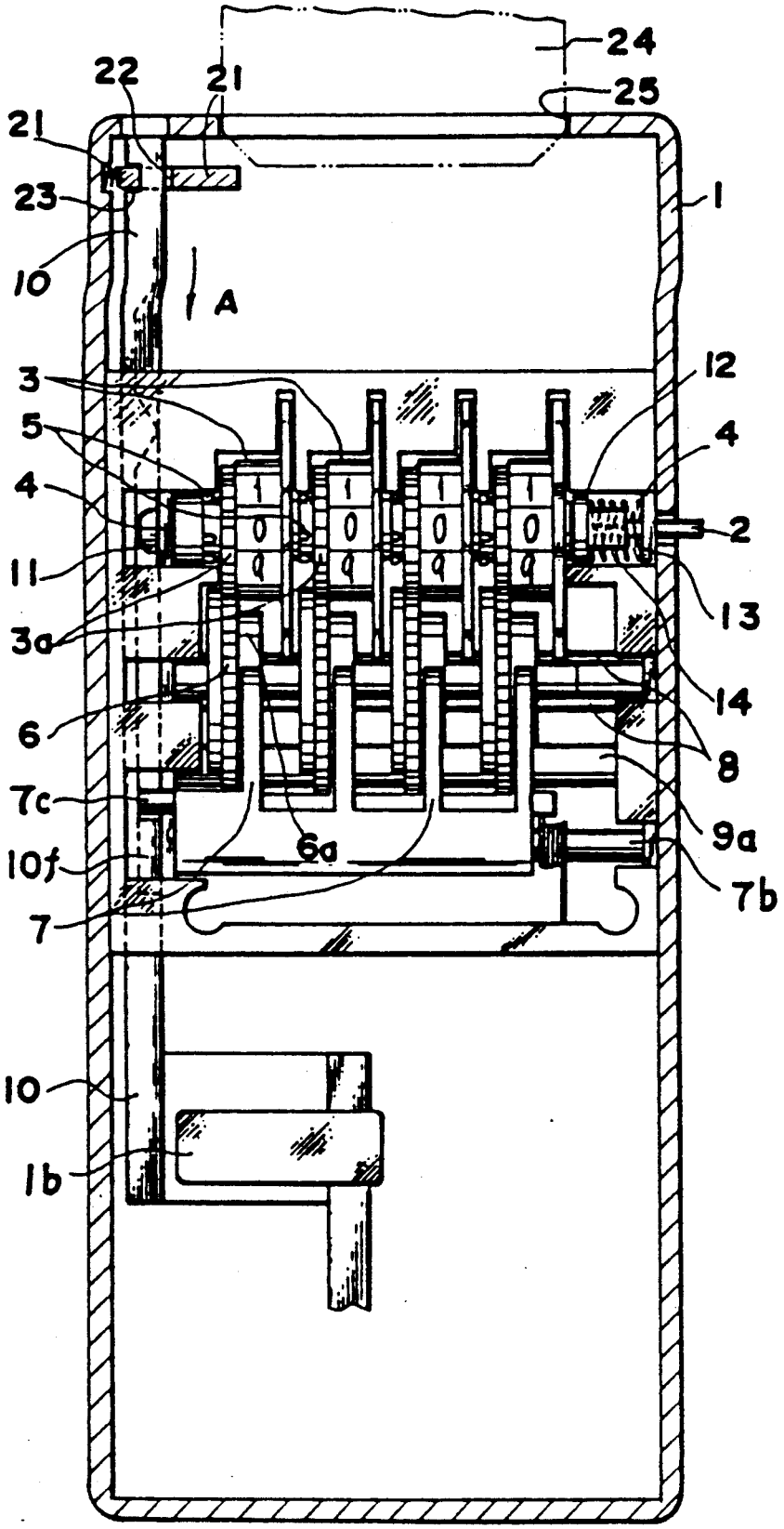
FIGS. 13 and 14 are front views of a second embodiment.
Figure 14:
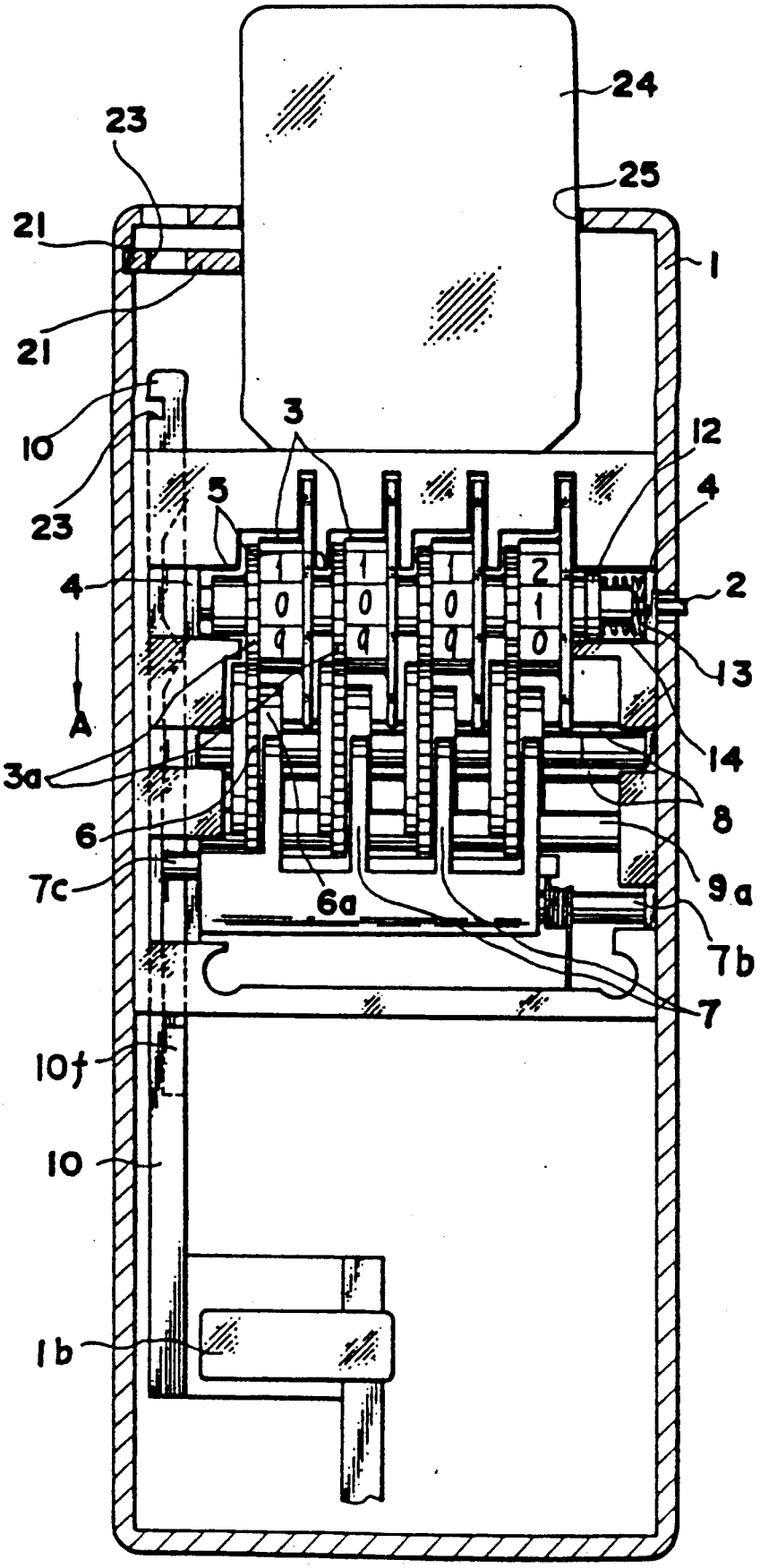

FIGS. 13 and 14 show a second embodiment of the present invention. Corresponding parts and components to the first embodiment are shown by the same numerals and marks, and the description thereon made in the first embodiment similarly apply. Differences and features of this second embodiment from the first embodiment are as follows. In the second embodiment, for prevention of improper locking by an unauthorized person, provided is improper locking prevention means (21+24) which comprises a slide bar latching member 21 for fixing the slide bar at a position, wherein the dial lock is unlocked, and a slide bar release member 24 for disengaging the slide bar 10 from the slide bar latching member 21. As shown in FIG. 13, at the time when the card-shaped slide bar release member 24 is inserted into the lock, an edge of an engaging hole 22 of the slide bar latching member 21 engages with the recess 23 of the slide bar, thereby to prevent the slide bar 10 from moving downward (in the direction of arrow A). With the slide bar release member 24 inserted through an insertion aperture 25, the slide bar latching member 21 is pushed by the slide bar release member 24 and hence is moved leftward of the drawing, whereby the slide bar 10 can move downward as shown in FIG. 14. Therefore, only a justified or authorized user having the slide bar release member 24 can lock the dial lock, thereby preventing the abuse. By the configuration that the slide bar release member 24 is inserted into the lock from the inside face of the door and is kept inside of the door during the locked period of the lock, abuse by the unauthorized person of the lock can be prevented.

In addition, by bearing the user's name, a specific number or mark on the slide bar release member 24 and by providing a window for showing such references therethrough, the user can easily find the locker assigned to him.

Third Embodiment

Figure 15:
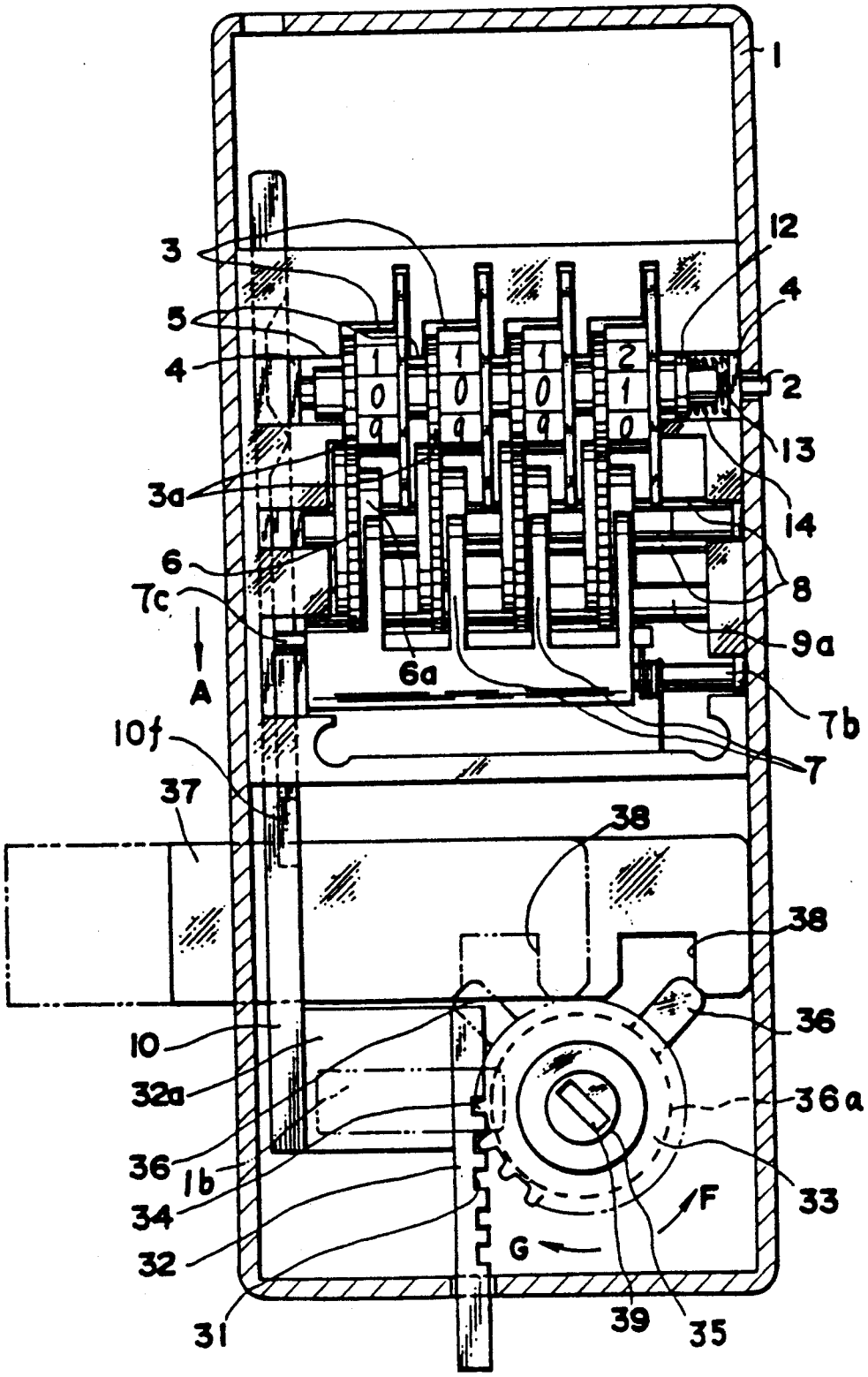
FIGS. 15, 16 and 17 are a front view, bottom plan view and side view, respectively, of a third embodiment.
Figure 16:
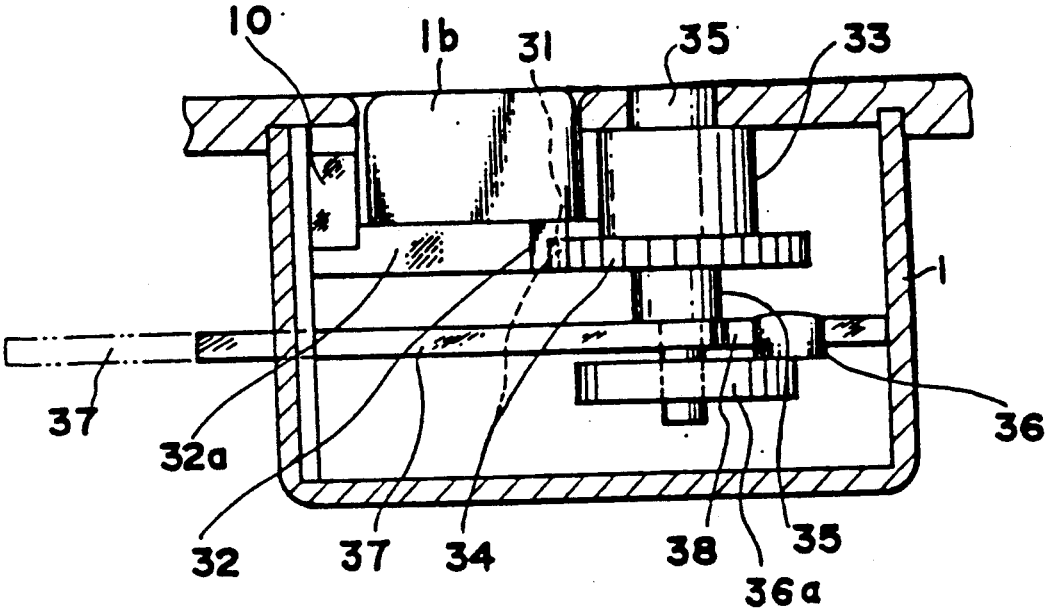
Figure 17:
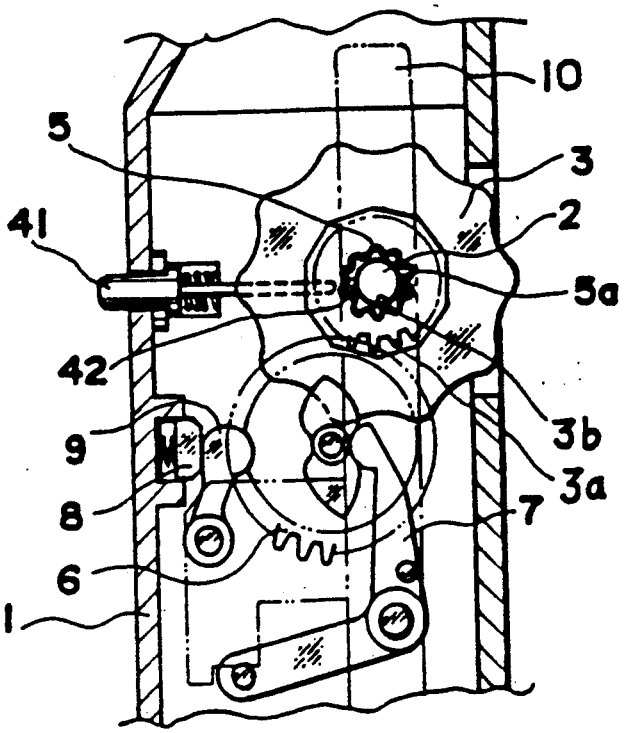

FIGS. 15, 16 and 17 show a third embodiment further comprises: unlocking means which permits the user to open the door even when the user has forgotten his unlocking number; and unlocking number retrieval means for retrieving, after opening the door by the above-mentioned unlocking member, the unlocking number that has been set by the user. Corresponding parts and components to the first embodiment are shown by the same numerals and marks, and the description thereon made in the first embodiment similarly apply. Differences and features of this third embodiment from the first embodiment are as follows. As shown in FIG. 15, in the third embodiment, a cylinder lock is used as unlocking means. The slide bar 10 is connected to a rod 32 having a rack 31 with a connecting member 32*a*. With the downward movement (in the direction of arrow A) of the slide bar 10, the rod 32 moves downward, and the rack 31 engages with a gear 34 on the outer cylinder 33 of the cylinder lock, to rotate the cylinder 33 in the direction of arrow F. An inner cylinder 35 rotates, too, in the direction of arrow F while following the outer cylinder 33 and a projection 36 formed on a disk 36*a* provided on the inner cylinder 35 engages with a recess 38 of a lock bolt 37 to thrust the lock bolt 37 to a locking part (not shown) for closing the door. After the door is thus closed, by inserting a key (not shown) into a key hole 39 of the cylinder lock and turned in the direction of arrow G, the outer cylinder 33 does not rotate, but only the inner cylinder 35 rotates in the direction of arrow G. The projection 36 engages with the recess 38 to pull out the lock bolt 37 from the locking part. As a result, the door is opened in such a state that the slide bar 10 is in the locking position (FIG. 15). In the third embodiment, a cylinder lock is used as unlocking means, however, no limit is imposed on the kind of unlocking means and any mechanism may suffice as far as it is capable of opening the door in such a state that the slide bar is fixed.

FIG. 17 shows unlocking number retrieval means. As shown in the drawing, a retrieval pin 41 opposing each of the dial lock gears is provided on the reverse side of the case 1. Each dial lock gear 5 is provided with a small hole 42. The small hole 42 is formed in a position at which the gate 5*a* of the dial lock gear 5 agrees with the projection 2*a* of the lock pin 2, when the small hole engages with the retrieval pin 4*a* and, to enable moving of the lock pin. By pressing the retrieval pin 41 to turn the corresponding dial 3, the retrieval pin 41 stops when engaging with the corresponding small hole 42 coming to a position opposite to the pin. At this time, the unlocking number appears through the number window 1*a* (FIG. 1*a*) and retrieval of the unlocking number is made possible in this way. And then, the slide bar 10 fixed at the locking position can be operated freely, so that the dial lock becomes again available for the usual use after setting of the unlocking number.

Fourth Embodiment

A fourth embodiment of the present invention will be described with reference to the drawings.

Figure 18:
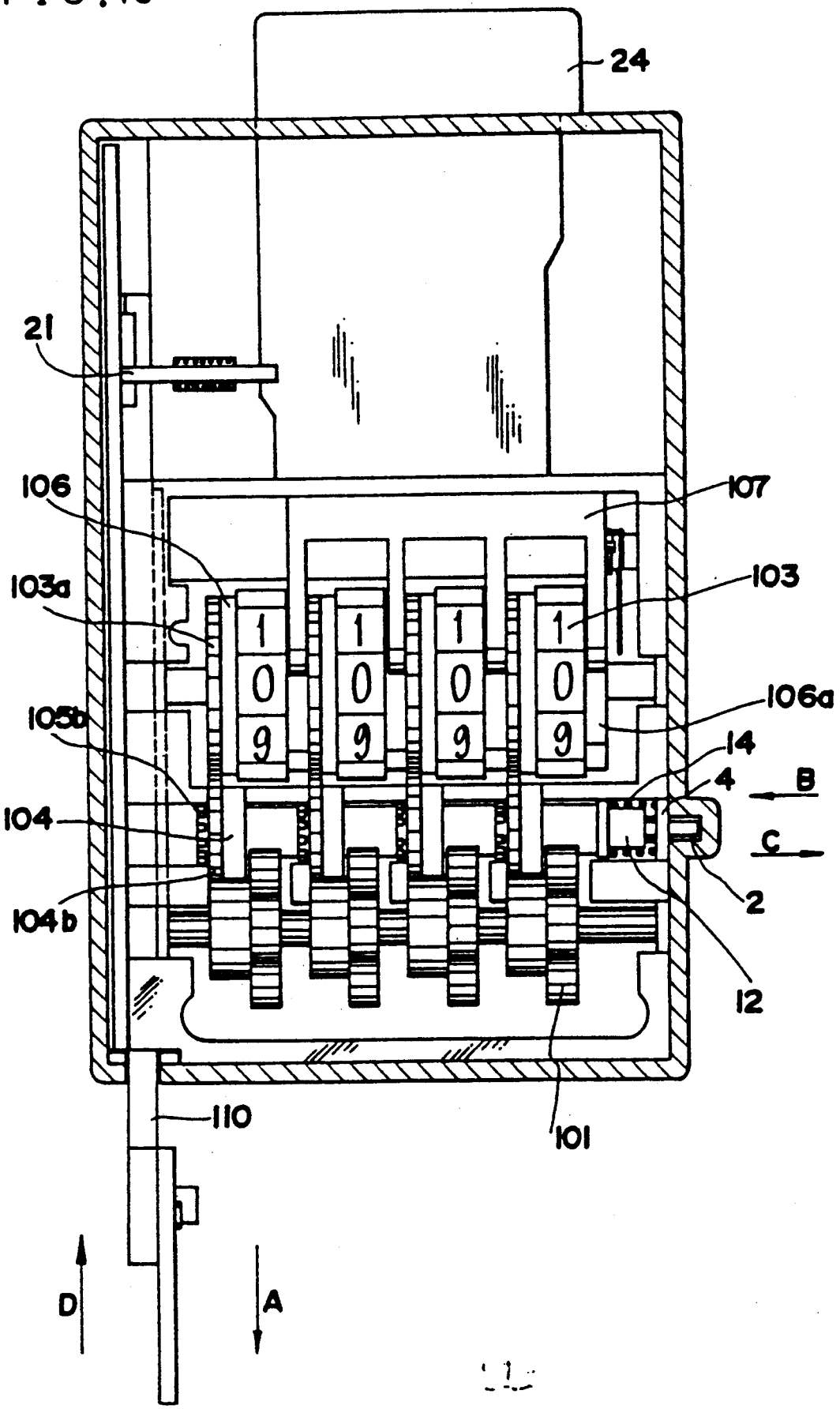
FIGS. 18 and 19 are a front view and a side view, respectively, of the inside of the setting part of the dial lock as a fourth embodiment unlocked.
Figure 19:
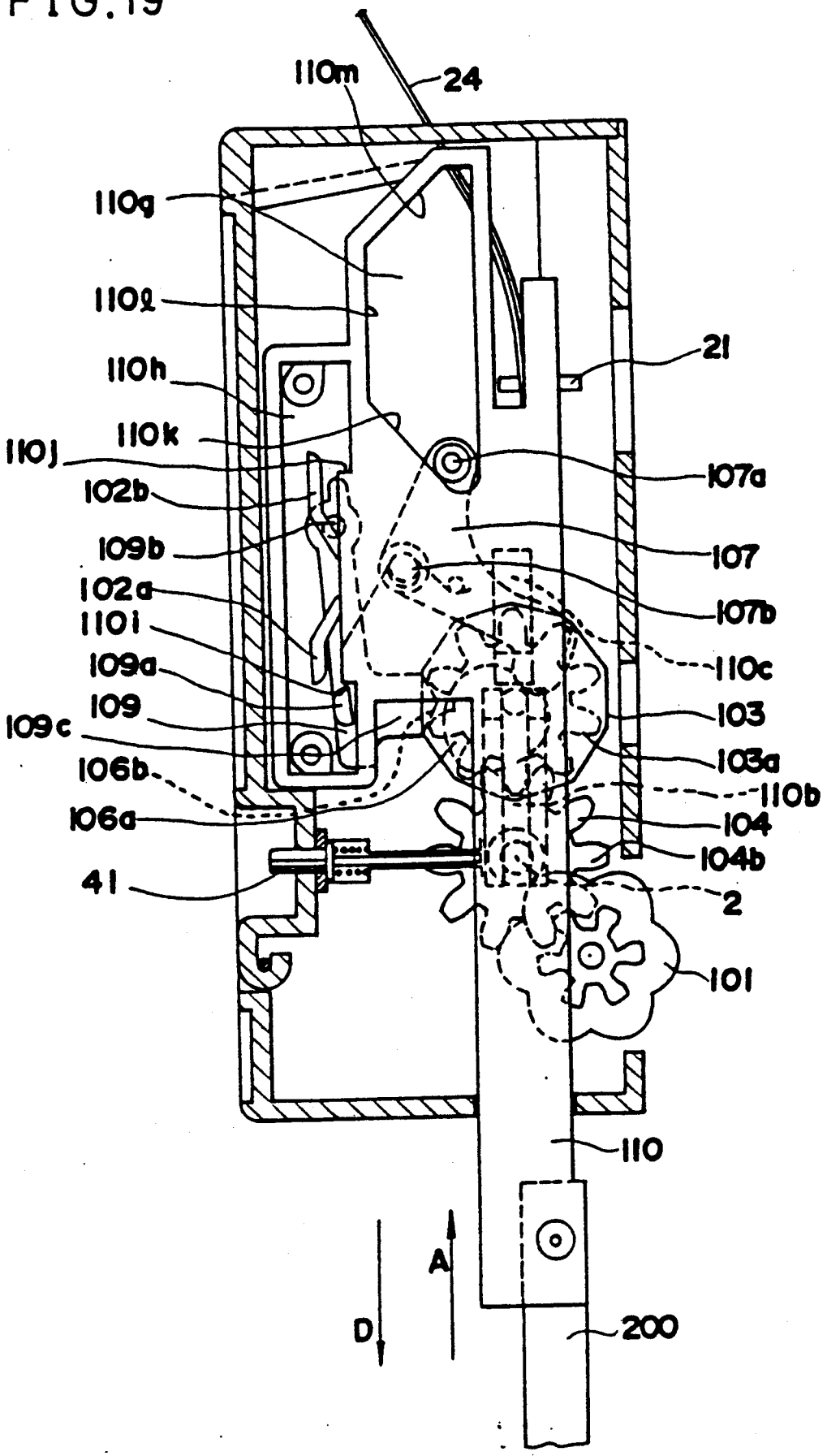

FIGS. 18 and 19 are a front elevation view and a side view, respectively, of the inner part of a dial lock in the state of unlocking. Corresponding parts and components to the first embodiment are shown by the same numerals and marks, and the description thereon made in the first embodiment similarly apply. Differences and features of this fourth embodiment from the first embodiment are as follows.

A manual operation plate 101 for number setting is provided on the side of the dial 3 in the first embodiment as described earlier; in the fourth embodiment, however, it is composed independently from the dial 3 as shown in FIGS. 18 and 19, and operation of the dial 3 is performed through an intermediate gear 104 provided between the plate and the dial. The shape of the slide bar 10 is modified from that of the first embodiment and, mechanism to move the arm 7 (FIG. 17) which is driven by the slide bar 10 is also modified, and further a mechanism to prevent the operation of the slide bar 10 at the time of locking and unlocking is added.

Figure 27:
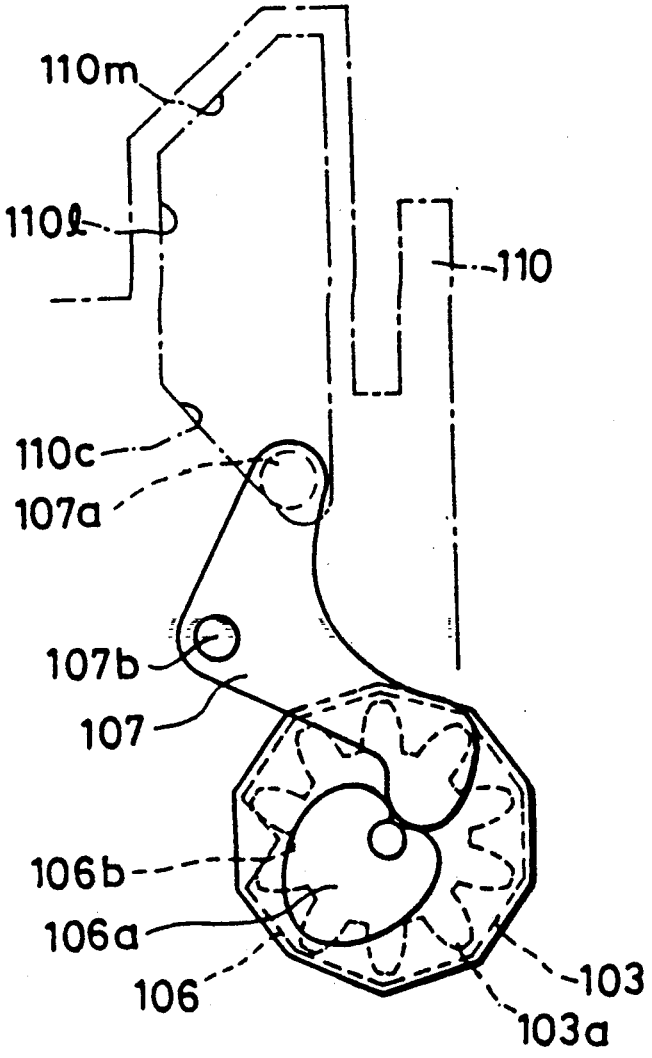
FIG. 27 shows an arm and a heart cam in engaging condition.

In the first embodiment, the mechanism has been such that engagement and disengagement between the dial 103 and the lock pin 2 depend on the axial displacement of the lock pin 2, dial lock gear 5, first bush 11, second bush 12, first spring 13, second spring 14, and lock pin 2 which are disposed on the inner side of the dial 3. However, in this fourth embodiment, the lock pin engaging-/disengaging mechanism is disposed on the inner side of the intermediate gear 104. The projection 10*b* and recess 10*c* for moving the slide bar 10 in the axial direction are disposed at the position on which one end of the slide bar 10 abuts in the first embodiment; but, in the fourth embodiment, the projection 110*b* and the recess 110*c* for axial displacement of the slide bar 110 are disposed in the position at which the lock pin 2 abuts on the slide bar 110. The slide bar 110 is provided with a hole 110*g* for displacement of the pin 107*a* and another hole 110*h* for displacement of the finger 109*a* of the interlocking lever 109. Return cams 102*a*, 102*b* are provided in opposing positions respectively on the inner side of the hole 110*h* of the slide bar 110 for controlling the moving direction of the finger 109*a* of the interlocking lever 109. A connecting member 200 to be connected to the lock part is fixed to the slide bar 110 for transmitting the action of the operation part of the locking part to the slide bar 110. Gearing teeth 103*a* engaging with the intermediate gear 104 and the return-to-zero gear 106 are coaxially fixed to one side of the dial 103. To the other side of the dial 103, a heart cam 106*a* is fixed in a position to make contact thereof with the arm 107, which is shown in FIG. 27.

The performance of a setting part of the above structure of the dial lock as the fourth embodiment will be described hereunder.

Operation from Unlocking to Locking

Figure 25:
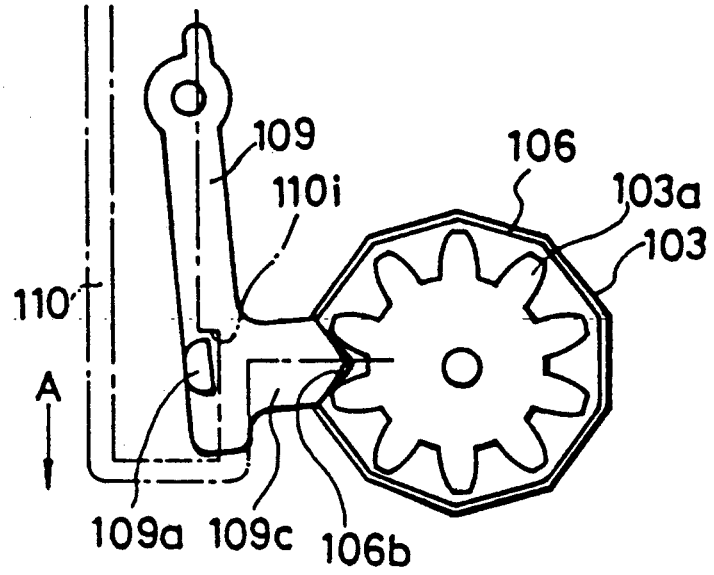
FIGS. 25 and 26 show the return-to-zero gear and the interlocking lever in engaging condition.

As described above with respect to the first embodiment, when the dial lock is in the state of unlocking, a plurality of dials 103, 103 . . . are all set at zero and a plurality of interlocking levers 109, 109 . . . corresponding to respective dials 103, 103 . . . are pressed and fit into cutouts 106*b* of the return-to-zero gears 106 by pressing means (for example, spring). As a result, the finger 109*a* provided on the interlocking lever 109 is in the position abutting the stepped part 110*i* of the slide bar 110 to prevent downward movement (in the direction of arrow A) of the slide bar 110, which is shown in FIG. 25.

Figure 20:
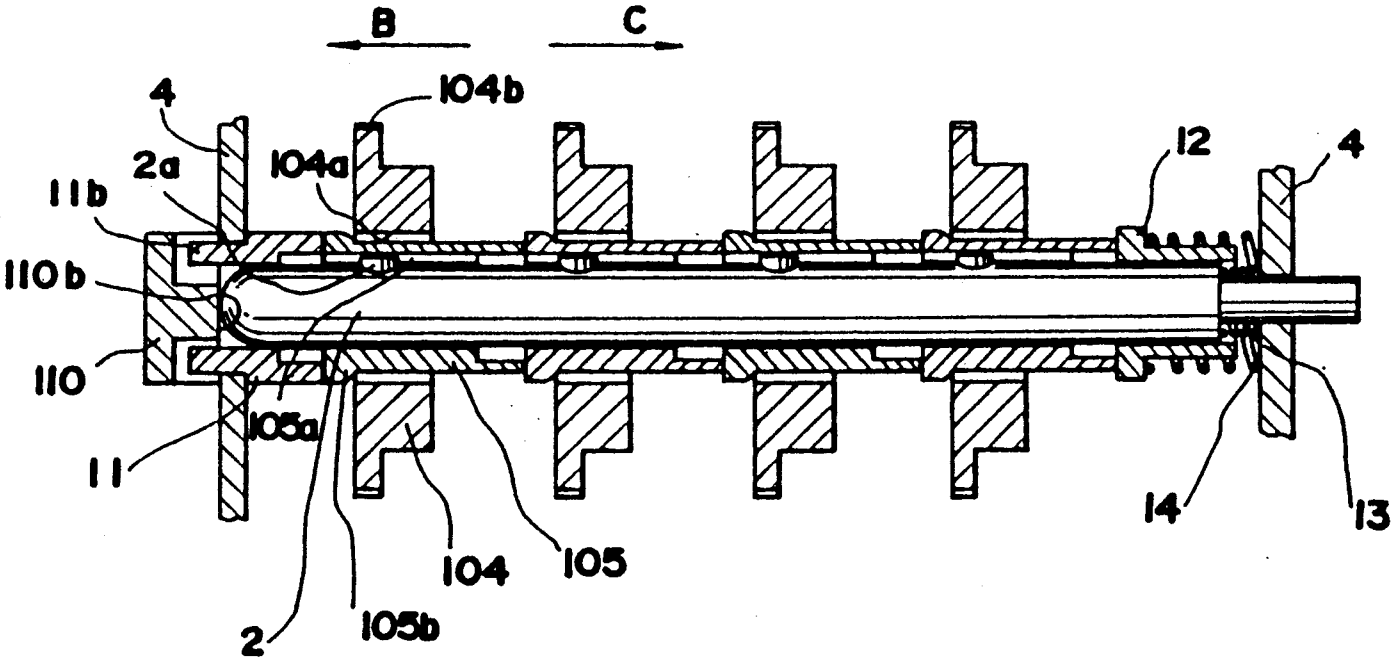
FIG. 20 is a view of the vicinity of the lock gear of the fourth embodiment unlocked.

The operation of the lock pin 2 disposed on the inner side of the intermediate gear 104 will be described. The lock pin 2 which was disposed on the inner side of the dial 3 in the first embodiment is disposed on the inner side of the intermediate gear 104. The state of the lock pin 2 during unlocking is shown in FIG. 20 and that during locking in FIG. 21. The lock gear 105 is shown in FIG. 22.

As described above with respect to the first embodiment, the lock pin 2 is pressed to move to the right side (in the direction of arrow C) by the projection 110*b* of the slide bar 110. On the other hand, the lock gear 105 is pressed to move to the left side (in the direction of arrow B) by the second bush 12. Therefore, the projection 2*a* formed on the lock pin 2 is fit into the gate 105*a* formed on the inner side of the lock gear 105, whereby the lock pin 2 interlocks with the lock gear 105. The lock gear 105, however, is pressed by the second spring 14 and, accordingly, the external gearing teeth 105*b* formed on the outer periphery of the lock gear 105 are out of engagement from the internal gearing teeth 104*a* formed on the inner periphery of the intermediate gear 104. As a result, the intermediate gear 104 is also out of engagement from the lock pin 2. The external gearing teeth 104*b* on the outer periphery of the intermediate gear 104 is constantly in engagement with the gearing teeth 103*a* of the dial 103 and those of the manual operation plate 101. Thereby, the dial 103 can optionally be rotated with the manual operation plate 101. Thus, setting of the unlocking number can be set in the above-described state. To the gearing teeth 103*a* of the dial 103 engaged with the external gearing teeth 104*b* of the intermediate gear 104, a movable hook 109*c* fixed to the interlocking lever 109 is pressed by the spring to make contact therewith. The dials 103, therefore, can exactly be stopped at respective positions of required numbers when setting of the numbers is intended.

Figure 26:
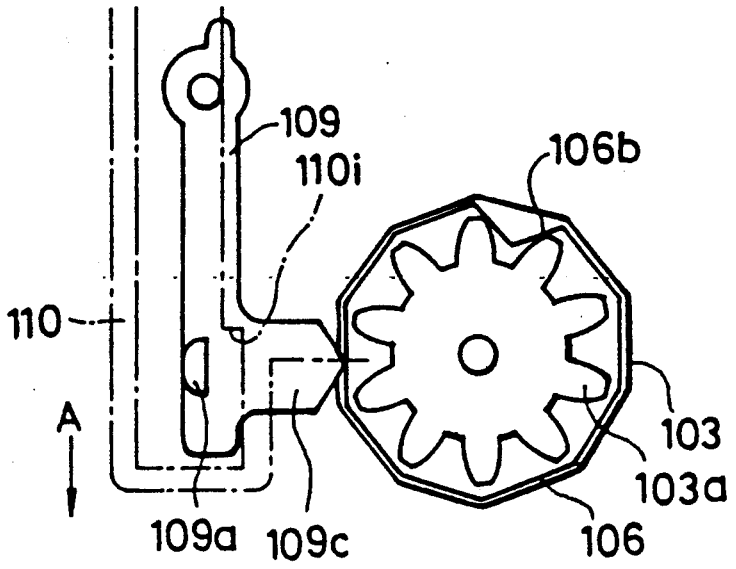

When the number other than zero is set (setting of a locking number) by rotating at least one of the manual operation plates 101 provided numerically corresponding to a plurality of dials 103, the return-to-zero gear 106 fixed to the side of the rotated dial 103 turns and the interlocking lever 109 is prevented from being fitted into the cutout 106*b* of the return-to-zero gear 106. Then, the interlocking lever 109 rotates around the shaft 109*b* in the direction to be raised higher than the return-to-zero gear 106 and the finger 109*a* is brought into a position at which the interlocking lever 109 is out of engagement from the stepped part 110*i* of the slide bar 110. Then, the slide bar 110 can be lowered down (in the direction of arrow A), which is shown in FIG. 26. That is, locking is impossible until setting of an unlocking number. When the slide bar 110 is lowered, the finger 109*a* of the interlocking lever 109 moves along the edge of a hole 110*h* while pushing and turning wide the return cam 102*a* and advances along the other return cam 102*a*. The interlocking lever 109, therefore, moves in such direction (in the leftward direction on FIG. 19) that it is raised further higher than the return-to-zero gear 106. The interlocking lever 109 acts to rise higher than the return-to-zero gear 106 in a distance substantially equal to two steps. In the state that the finger 109*a* is on the second step while moving along the return cam 102*b*, the movable hook 109*c* fixed to the interlocking lever 109 is out of contact with the return-to-zero gear 106 of the dial 103, whereby the dial 103 is made free to turn.

On the other hand, with the slide bar 110 lowered (in the direction of arrow A), the pin 107*a* of the arm 107 moves along the edge of the hole 110*g* of the slide bar 110. At this time, the arm 107 is constantly subjected to a turning force in the counterclockwise direction on FIG. 19 around the axis 107*b*. The pin 107*a* of the arm 107, therefore, moves along the edges 110K, 110, 110*m* of the hole 110*g* in succession with the slide bar 110 lowered down. Such movement of the pin 107*a* turns the arm 107 around the axis 107*b*. When the pin 107*a* moves along the edge 110K, the arm 107 gradually recedes from the heart cam 106*a*. With the movement of the pin 107*a* along the hold edge 110*m*, the arm 107 abuts and presses against the heart cam 106*a*. The arm 107 finally abuts the recessed part of the heart cam 106*a* and thereby stops the heart cam 106*a*. Thus, contact of the arm 107 with the heart cam 106*a* adapts the dial 103 to return to the zero-indicating position.

When the dial 103 returns to the zero-indicating position, the interlocking lever 109 is fit into the cutout 106*b* of the return-to-zero gear 106 and the finger 109*a* is in a position permitting interlocking thereof with the stepped part 110*j* of the slide bar 110. Accordingly, the upward movement (in the direction of arrow D) of the slide bar 110 is prevented.

Figure 21:
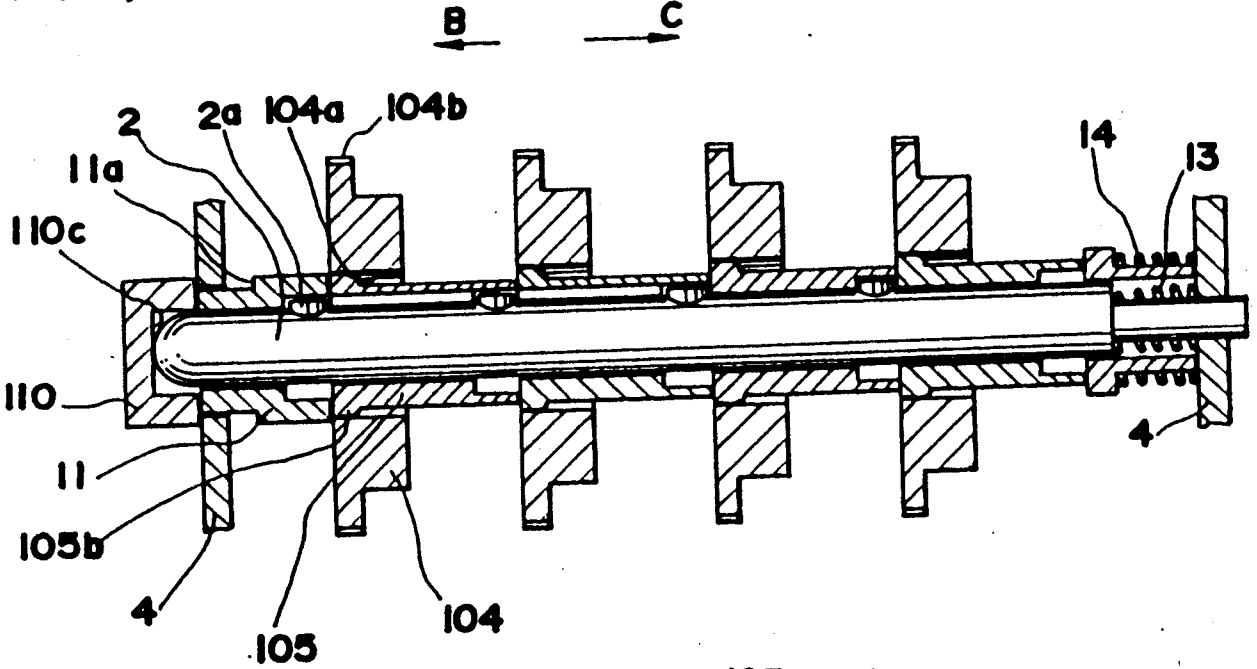
FIG. 21 is a view of the vicinity of the lock gear of the fourth embodiment locked.
Figure 22:
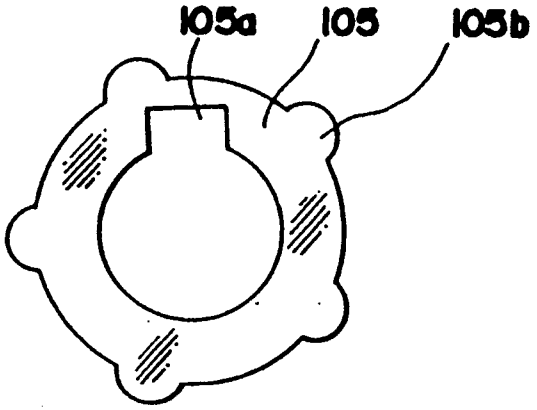
FIG. 22 is a view of the lock gear of the fourth embodiment.

With lowering of the slide bar 110 as described above, the lock pin 2 disposed on the inner side of the intermediate gear 104 is fit into the recess 110*c* of the slide bar 110 as shown in FIG. 21, and moves leftward on the drawing (in the direction of arrow B). The lock gear 105 is pushed by the first bush 11 and moves rightward (in the direction of arrow C). Then, the external gearing teeth 105*b* of the lock gear 105 engage with the internal teeth 104*a* of the intermediate gear 104. While, the projection 2*a* of the lock pin 2 is detached from the gate 105*a* of the lock gear 105 and engagement between the lock pin 2 and the lock gear 105 is released.

When the dial 103 returns to the zero-indicating position during the abovesaid state, the lock gear 105 rotates together with the intermediate gear 104 and the projections 2*a* of the lock pin 2 deviate in the circumferential direction and strike the lock gears 105 to prevent the lock pin 2 from moving to the right side (in the direction of arrow C). Accordingly, in the same way as in the first embodiment, the lock pin 2 abuts the slant surface of the slide bar 110 when upward lifting (in the direction of arrow D on FIG. 19) of the slide bar 110 is intended, whereby the slide bar 110 can not be raised upward. Thus, the dial lock is brought into the state of locking.

Operation from Locking to Unlocking

The operation of the fourth embodiment during the process from locking to unlocking is elucidated. In the state of locking, when the dial 103 having returned to the zero-indicating position is set at an unlocking number with the manual operation plate 101, the gate 105*a* of the lock gear 105 having deviated agrees with the circumferential direction of the projections 2*a* of the lock pin 2. When the unlocking numbers other than zero are set, at least one of the return-to-zero gears 106 coaxially fixed to the sides of the dials 103 rotates and the interlocking lever 109 is prevented from engaging with the cutout 106*b* of the return-to-zero gear 106. Then, the interlocking lever 9 is raised higher than the return-to-zero gear 106, and the finger 109*a* of the interlocking lever 109 is positioned to be out of engagement from the stepped part 110*j* of the slide bar 110. When the slide bar 110 is raised in such a state as above, one end of the lock pin 2 abuts on the projection 110*b* of the slide bar 110 in the same way as in the case of the first embodiment. And the lock pin 2 is moved rightward (in the direction of arrow C). As a result of such performance as above, it becomes possible to raise the slide bar 110.

When the slide bar 110 is raised in such a way as above, the finger 109*a* of the interlocking lever 109 moves along the edge of the hole 110*h*, turning wide the return cam 102*b* disposed on one side; and the finger 109*a* also moves along the return cam 102*a* on the other side. The interlocking lever 109 thereby moves in the direction (leftward on FIG. 19), to further rise higher than the return-to-zero gear 106. Similarly to the operation of the interlocking lever 109 for locking, when the interlocking lever 109 acts to rise higher than the return-to-zero gear 106 by substantial two steps and reaches the second step, the movable hook 109*c* is out of contact with the gearing teeth 103*a* of the dial 103.

On the other hand, with the slide bar 110 raised (in the direction of arrow D), the pin 107*a* of the arm 107 moves along the edge of the hole 110*g* of the slide bar 110. The direction of movement at this time is opposite to that of the movement of the pin 107*a* at locking. In other words, when the slide bar 110 is raised, the pin 107*a* moves along the hole edges 110*m*, 110 and 110*k* in succession. When the pin 107*a* moves along hole edge 110*k*, the arm 107 abuts on and turns the heart cam 106*a*. The arm 107 then abuts on the recess of the heart cam 106*a* and stops turning of the heart cam 106*a*. With the arm 107 abutting the recess of the heart cam 106*a*, the dial 103 is returned to the zero-indicating position.

When the dial 103 is returned to the zero-indicating position, the interlocking lever 109 is fit into the cutout 106*b* of the return-to-zero gear 106 and the finger 109*a* is brought into a position to engage with the stepped part 110*i* of the slide bar 110. Thus, the downward movement of the slide bar 110 (in the direction of arrow A) is prevented.

With the slide bar 110 raised upward, the projection 110*b* of the slide bar 110 abuts one end of the lock pin 2 and the first bush 11 coaxially provided on the intermediate gear 104 does not abut the projection 110*b* of the slide bar 110, but moves leftward (in the direction of arrow B) to a position at which the stepped part 11*a* of the first bush 11 abuts the fixed plate 4. On the other hand, the lock gear 105 is pressed by the second bush 12 energized by the second spring 14 and is moved leftward (in the direction of arrow B). The internal gearing teeth 194*a* of the intermediate gear 104 are released from engagement with the external teeth 105*b* of the lock gear 105.

In this way, the initial state of unlocking is restored.

As has been described above, in the fourth embodiment (FIGS. 18 and 19) of the present invention, a manual operation plate 101 is structurally independent from the dial 103 and an intermediate gear 104 is provided there-between. Thus, the major mechanism of the invention may be disposed on the inner side of the intermediate gear 104. As a result, the dial 103 is not covered with the user's finger and is easy for setting of the locking and unlocking numbers. Since the mechanism such as a lock pin 2 and others disposed on the inner side of the dial 103 in the first embodiment is on the inner side of the intermediate gear in the fourth embodiment, the dial 103 is freed from rightward and leftward thrust caused by vertical movement of the slide bar 110. Thereby, the digit of the dial 103 does not deviate right and left from the digit window, and is always put in a fixed position. The movable hook 109*c* is constantly pressed by the spring against the gearing teeth 103*a* of the dial 103, and thereby the digit of the dial 103 does not deviate above and below, and it is brought into a fixed position. The heart cam 106*a* for returning the dial 103 to the zero-indicating position is fixed to the side of the dial 103, and thereby pressed by the arm 107, and thereby the rotation of the heart cam 106*a* may directly be transmitted to the dial 103 and returning thereof to the zero-indication position may be exact.

In this fourth embodiment, a setting part is constructed independently from the locking part and connected to each other through connecting member 200. Accordingly, the setting part and the locking part are separately disposed above and below on the door to which a dial lock of the present invention is fixed, and the manual operation plate 101 and the dial 103 are in positions enabling easy handling thereof.

Fifth Embodiment

Figure 23:
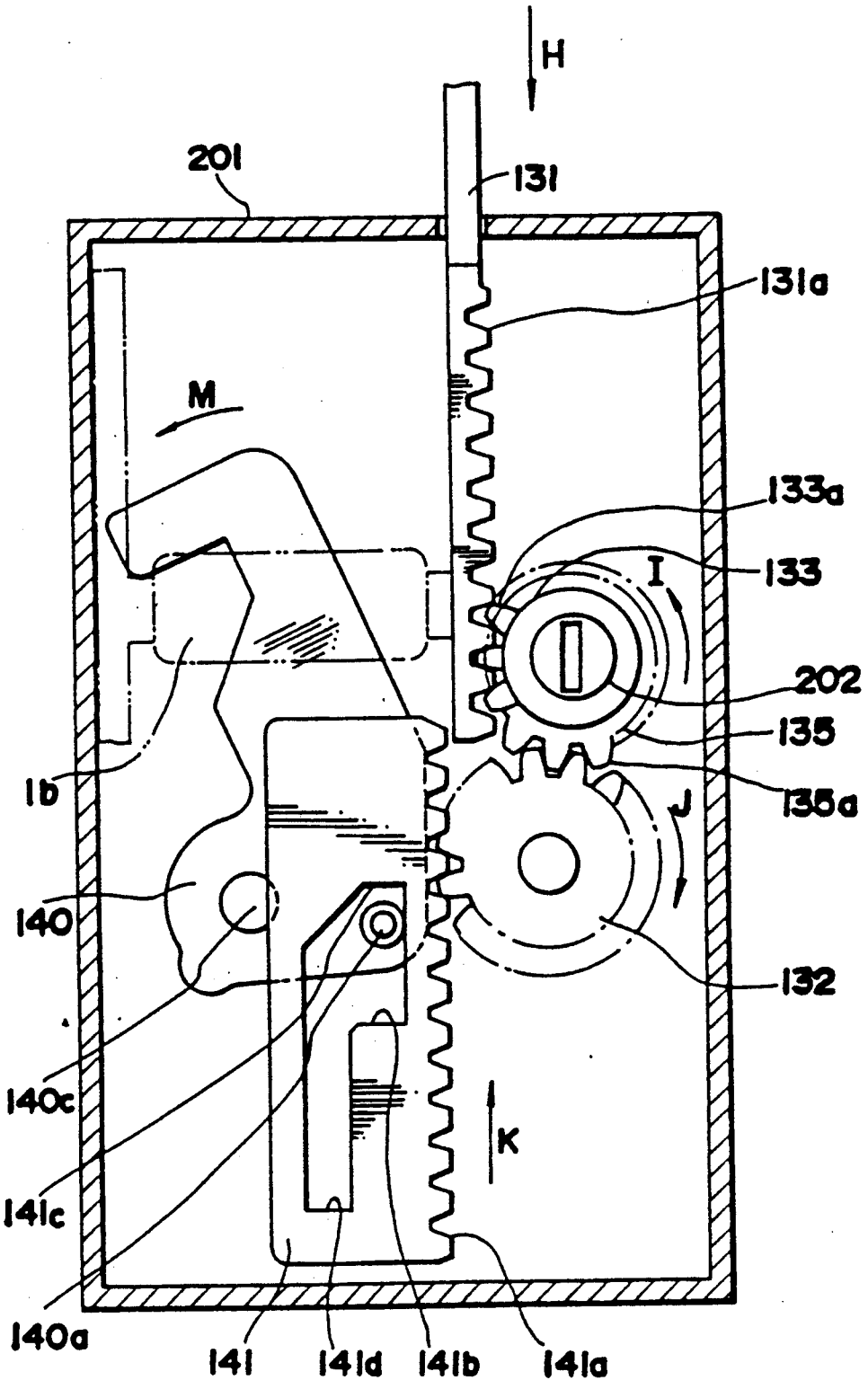
FIG. 23 is a plan view of the inside of the lock part of a dial lock as a fifth embodiment unlocked.
Figure 24:
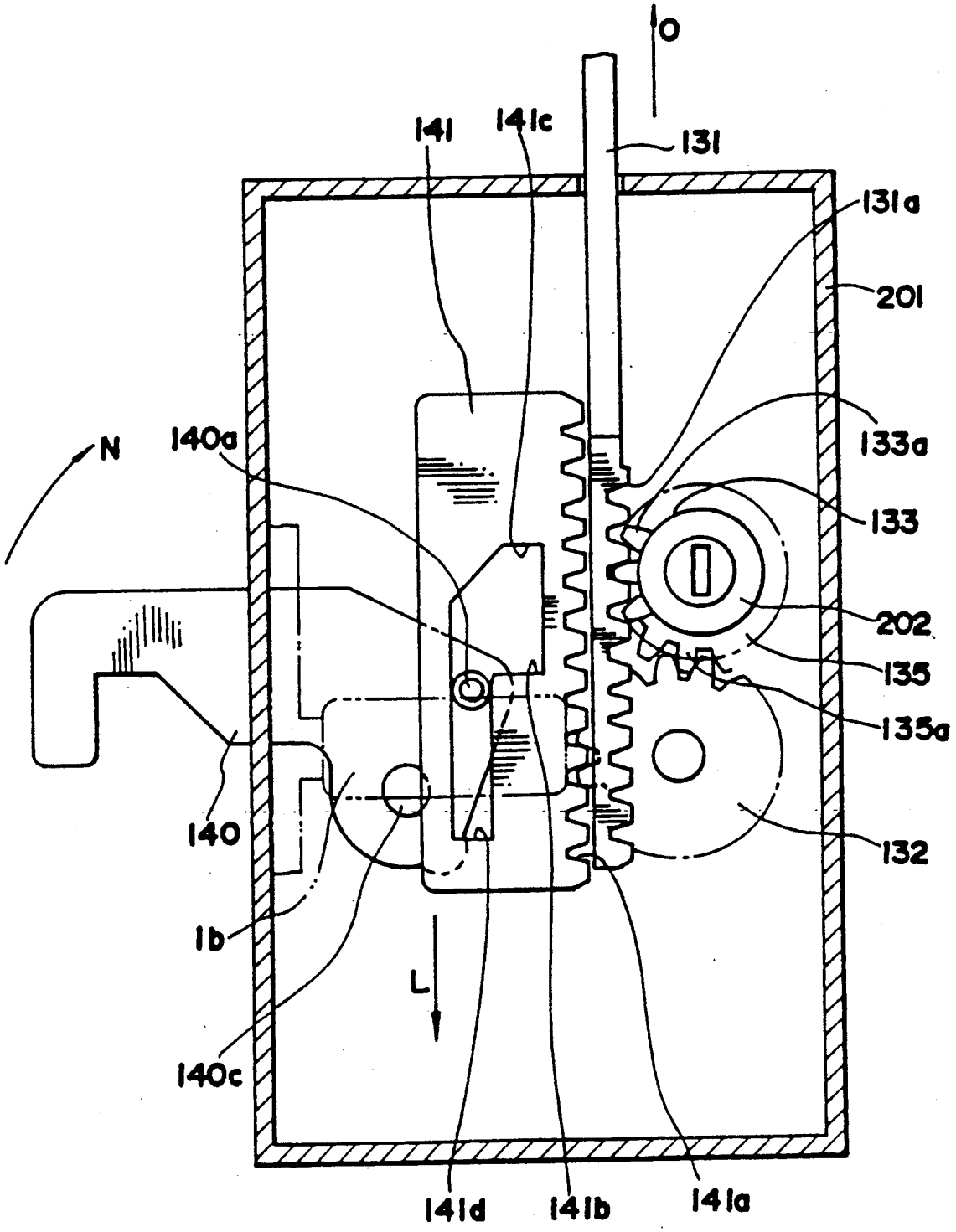
FIG. 24 is a plan view of the inside of the lock part of a dial lock as the fifth embodiment locked.

A fifth embodiment of the present invention is shown in FIGS. 23 and 24. The fifth embodiment is an example of a locking part of a dial lock, FIGS. 23 and 24 are front views showing the inside of the locking part. In these drawings, a rack bar 131 provided with rack teeth 131*a* is connected to the slide bar 110 of the setting part with connecting members. An operation part 1*b* to be operated from the outside of the door is fixed to the rack bar 131. Corresponding parts and components to the first embodiment are shown by the same numerals and marks, and the description thereon made in the first embodiment similarly apply. Differences and features of this fifth embodiment from the first embodiment are as follows. When the operation part 1*b* is moved in the downward direction, the rack bar 131, too, moves downward (in the direction of arrow H) and the rack teeth 131*a* of the rack bar 131 engage with an outer cylinder 133 of the cylinder lock 202 to rotate the outer cylinder 133 in the direction of arrow I. Following the rotation of the outer cylinder, an inner cylinder 135 of the cylinder lock 202 rotates in the direction of arrow I and gearing teeth 135*a* of the inner cylinder 135 rotates the pinion gear 132 in the direction of arrow J. The rotation of the pinion gear 132 in the direction of arrow J moves a rack plate 141 provided with rack teeth 141*a* in the direction of arrow K. At this time, a stepped part 141*b* provided on the rack plate 141 interlocks with a pin 140*a* of the lock plate 140 for rotating the lock plate 140 in the direction of arrow M. The lock plate 140 rotates around an axis 140*c*. Then, the pin 140*a* of the lock plate 140 is disengaged from the stepped part 141*b* of the rack plate 141 and moves in the direction toward the recess 141*d*. Thus, the lock plate 140 projects from the case 201 of the locking part and brings about a state of locking. The pin 140*a* of the lock plate 140 in the above state is fit into the recess 141*d* and the lock plate 140 cannot be rotated even if subjected to an external rotating force.

When the operation part 1*b* is driven to be raised upward (in the direction of arrow O), the rack bar 131, cylinder lock 202, and pinion gear 132, act in the directions respectively, opposite to the afore-mentioned ones which are when the operation part 1*b* is lowered (in the direction of arrow H). The rack plate 141 thereby moves downward (in the direction of arrow L) and the pin 140*a* of the lock plate 140 moves along the hole edge of the rack plate 141 to cause engagement of the pin 140*a* with the recess 141*c*. The lock plate 140 rotates in the direction of arrow N to enter the inside of the case 201 of the lock part and brings about a state of unlocking.

The lock plate 140 is constantly pressed in such a direction for retaining the plate in the case by a pressing member (for example, spring) to prevent it from projecting out of the case 201 when influenced by vibration or the like during unlocking.

As described above, in this fifth embodiment, the pin 104*a* is fit into the recess 141*d* of the rack plate 141. Therefore, the lock plate 140 is brought into the complete locking and repels unlocking even when external strong force is exerted on the lock plate 140. The cylinder lock 202 is so constructed as to permit the user to open the door even when he forgets the unlocking number. The fifth embodiment is also provided with unlocking number retrieval means, as described above with respect to the third embodiment, for retrieving an unlocking number having been set by the use after opening the door using the cylinder lock 202 instead of operating the digital dials.

The provision of slide bar catching means and slide bar releasing means in this fifth embodiment and as described above for the second embodiment can prevent abuse of the unauthorized person.

Since the dial lock in accordance with the present invention permits setting of an unlocking number by operating the dial only, easy setting and a complete replacement of the unlocking number at each use is possible. Since the structure is made so that the dial is returned to the zero-indicating position when the dial lock is locked by the locking operation of the slide bar, and again is returned to the zero-indicating position when the dial lock is unlocked after setting the unlocking number, a third party or unauthorized person can be prevented from knowing the unlocking number. Moreover, abuse preventive means also prevents the undue use by the third party or unauthorized person.

Furthermore, when the dial lock is provided with unlocking means and unlocking number retrieval means, the door can be opened by unlocking means by use of a master key which is in the custody of the locker manager when the user may have forgotten the unlocking number, and the unlocking number having slipped the user's memory can be retrieved, and thereby the dial lock that has been locked can easily be restored to be unlocked.

Although the invention has been described in its preferred forms with a certain degree of particularity, it is understood that the present disclosure of the preferred forms can be changed in the details of construction and different combinations and arrangements of parts may be resorted to without departing from the spirit and the scope of the invention as hereinafter claimed.

For example, the fourth embodiment, the structure is such that the dials 103 return to the zero-indicating position at the moment of locking or unlocking. However, the construction may be that it returns to positions indicating other numbers than zero.

A structure comprising the manual operation plate and the dial which are independent from each other enables easy setting of locking and unlocking numbers as well as an exact arrangement of digits of the dials in fixed positions all the time. Further, by providing the setting part separately from the locking part, easy operation of the setting part is made possible. In addition, a device which fits a part of the lock plate into a part of the rack plate at the time of locking in the locking part can securely prevent forcible unlocking by an outsider.

What is claimed is:

1. A setting part of a dial clock comprising:

a lock pin having a plurality of projections formed at fixed spatial intervals along said axial direction thereof;

a slide bar having a projection and recess in a fixed configuration at said side thereof abutting one end of said lock pin, subjected to control over said movement thereof by engagement of said projection and recess with said lock pin, and serving for opening and closing said door while acting in association with said locking part to lock said door;

lock gears disposed on the same axis as the rotating axis of said lock pin, numerically corresponding to projections of said lock pin, having gates to detachably engage with projections of said lock pin of the inner periphery and also having gearing teeth on the outer periphery thereof;

intermediate gears having internal teeth to detachably engage with external teeth of said lock gears and further having gearing teeth on the other part, for example, the outer periphery thereof;

dials having gearing teeth to interlock with external teeth of said intermediate gears and each provided with code digits on the outer periphery thereof;

return-to-zero gears fixed to said dials for returning said dials to the zero-indicating positions;

interlocking levers to catch said slide bar while engaging with said return-to-zero gears when said dials are all set at zero and to permit locking operation of said slide bar when at least one of said dials is set at any number other than zero;

return cams provided on said slide bar for controlling the operation of said interlocking levers;

arms acting in association with locking and unlocking operation of said slide bar and driving said return-to-zero gears for adapting said dials to return to the zero-indicating positions at the time of locking and unlocking; and manual operation plates having gearing teeth to engage with said external gearing teeth of said intermediate gears.

2. A dial lock in accordance with claim 1, which is provided with, at said locking part:

a rack plate operating in association with locking and unlocking operation of said slide bar; and a lock plate to be locked or unlocked by the action of said rack plate said lock plate having a projection to be fitted into a part of said rack plate at the time of locking.

3. A dial lock in accordance with claim 1 which comprises:

improper locking prevention means having slide bar latching means for latching said slide bar at an unlocking position; and slide bar release means for disengaging said slide bar from said slide bar latching means to enable a locking operation of said slide bar.

4. A dial lock in accordance with claim 1 which comprises:

unlocking means to open said locking part of said closed door without actuating said slide bar, and retrieval pin which is inserted into a small hole formed in a fixed position on each lock gears when said gates of said lock gears positionally agree with said projections of said lock pin.

* * * * *